US010181394B2

(12) United States Patent
Bazargan et al.

(10) Patent No.: US 10,181,394 B2
(45) Date of Patent: Jan. 15, 2019

(54) SYSTEMS AND METHODS FOR AUTOMATED OPTIMIZATION OF A MULTI-MODE INDUCTIVELY COUPLED PLASMA MASS SPECTROMETER

(71) Applicant: PerkinElmer Health Sciences, Inc., Waltham, MA (US)

(72) Inventors: Samad Bazargan, Richmond Hill (CA); Hamid Badiei, Woodbridge (CA); Pritesh Patel, Pickering (CA)

(73) Assignee: PerkinElmer Health Sciences, Inc., Waltham, MA (US)

( * ) Notice: Subject to any disclaimer, the term of this patent is extended or adjusted under 35 U.S.C. 154(b) by 414 days.

(21) Appl. No.: 14/622,132

(22) Filed: Feb. 13, 2015

(65) Prior Publication Data

US 2015/0235827 A1 Aug. 20, 2015

Related U.S. Application Data

(60) Provisional application No. 61/940,349, filed on Feb. 14, 2014.

(51) Int. Cl.
*H01J 49/10* (2006.01)
*H01J 49/00* (2006.01)
*H01J 49/06* (2006.01)

(52) U.S. Cl.
CPC ..... *H01J 49/0009* (2013.01); *H01J 49/105* (2013.01); *H01J 49/0027* (2013.01); *H01J 49/061* (2013.01)

(58) Field of Classification Search
CPC .. H01J 49/0009; H01J 49/105; H01J 49/0027; H01J 49/061

(Continued)

(56) References Cited

U.S. PATENT DOCUMENTS 5,565,679 A * 10/1996 Tanner ..... H01J 49/044 250/282
6,140,638 A 10/2000 Tanner et al.
(Continued)

FOREIGN PATENT DOCUMENTS

CN 203325832 U 12/2013
EP 2602809 A1 6/2013
(Continued)

OTHER PUBLICATIONS

Agilent Technologies, Agilent 7500 ICP-MS ChemStation (G1834B) Operators Manual, 12 pages (2005).
(Continued)

*Primary Examiner* — Ly D Pham
(74) *Attorney, Agent, or Firm* — Banner & Witcoff, Ltd.

(57) ABSTRACT

The present disclosure provides methods and systems for automated tuning of multimode inductively coupled plasma mass spectrometers (ICP-MS). In certain embodiments, a 'single click' optimization method is provided for a multi-mode ICP-MS system that automates tuning of the system in one or more modes selected from among the multiple modes, e.g., a vented cell mode, a reaction cell mode (e.g., dynamic reaction cell mode), and a collision cell mode (e.g., kinetic energy discrimination mode). Workflows and computational routines, including a dynamic range optimization technique, are presented that provide faster, more efficient, and more accurate tuning.

25 Claims, 18 Drawing Sheets

(58) Field of Classification Search
USPC ..... 702/116
See application file for complete search history.

(56) References Cited

U.S. PATENT DOCUMENTS

| | | | | |
|---|---|---|---|---|
| 6,627,912 | B2 | 9/2003 | Bandura et al. | |
| 8,426,804 | B2 | 4/2013 | Badiei et al. | |
| 9,620,343 | B1 * | 4/2017 | Field | H01J 49/0422 |
| 2001/0027382 | A1 | 10/2001 | Jarman et al. | |
| 2006/0057554 | A1 * | 3/2006 | Watling | A61B 5/151 435/4 |
| 2006/0255258 | A1 | 11/2006 | Wang et al. | |
| 2007/0045529 | A1 | 3/2007 | Cao et al. | |
| 2007/0110144 | A1 | 5/2007 | Teshima | |
| 2008/0067340 | A1 | 3/2008 | Bloomfield | |
| 2008/0099671 | A1 | 5/2008 | Sakata et al. | |
| 2008/0257753 | A1 * | 10/2008 | Burton | B01D 24/008 205/742 |
| 2008/0296490 | A1 | 12/2008 | Hidalgo et al. | |
| 2011/0019187 | A1 | 1/2011 | Mizukami et al. | |
| 2011/0210241 | A1 * | 9/2011 | Badiei | G05D 7/0635 250/282 |
| 2012/0091331 | A1 | 4/2012 | Badiei et al. | |
| 2013/0038878 | A1 | 2/2013 | Muraki | |
| 2013/0268212 | A1 | 10/2013 | Makarov et al. | |
| 2014/0083544 | A1 * | 3/2014 | Chan | G05D 7/03 137/872 |
| 2014/0218729 | A1 * | 8/2014 | Marcus | H01J 49/105 356/316 |
| 2015/0102215 | A1 * | 4/2015 | Jung | H01J 49/005 250/282 |
| 2015/0235833 | A1 | 8/2015 | Bazargan et al. | |
| 2015/0262804 | A1 * | 9/2015 | Martinez Jarquin | H01J 49/142 250/288 |
| 2017/0266670 | A1 * | 9/2017 | Stein | B03C 1/30 |
| 2017/0358438 | A1 | 12/2017 | Bazargan et al. | |
| 2018/0002806 | A1 * | 1/2018 | Verbeck, IV | C23C 14/14 |

FOREIGN PATENT DOCUMENTS

| | | | |
|---|---|---|---|
| JP | 2002-541556 | A | 12/2002 |
| JP | 2004-347473 | A | 12/2004 |
| JP | 2008111744 | A | 5/2008 |
| JP | 2008-536147 | A | 9/2008 |
| JP | 2009129868 | A | 6/2009 |
| JP | 2011257333 | A | 12/2011 |
| JP | 2014-501430 | A | 1/2014 |
| WO | WO-00/60493 | A2 | 10/2000 |
| WO | WO-2006/110848 | A2 | 10/2006 |
| WO | WO-2009/131175 | A1 | 10/2009 |
| WO | WO-2011/106768 | A1 | 9/2011 |
| WO | 2012062964 | A1 | 5/2012 |
| WO | WO-2015/122920 | A1 | 8/2015 |
| WO | WO-2015/123555 | A1 | 8/2015 |

OTHER PUBLICATIONS

International Search Report, PCT/US2015/015875, 4 pages (dated May 8, 2015).
McCurdy, E. et al., The Measure of Confidence, Agilent ICP-MS Journal, Issue 48, 8 pages (2011).
Written Opinion, PCT/US2015/015875, 8 pages (dated May 8, 2015).
Borovinskaya, O. et al., A prototype of a new inductively coupled plasma time-of-flight mass spectrometer providing temporally resolved, multi-element detection of short signals generated by single particles and droplets, Journal of Analytical Atomic Spectrometry, 28:2:226-233, (2013).
Cornelis, G. and Hassellov, M., A signal deconvolution method to discriminate smaller nanoparticles in single particle ICP-MS, J. Anal. At. Spectrom., 29:134-144, (2014).
Gschwind, S. et al., Capabilities of inductively coupled plasma mass spectrometry for the detection of nonoparticles carried by monodisperse microdroplets, Journal of Analytical Atomic Spectrometry, 26:6:1166-1174, (2011).
Hineman, A. et al., Effect of dwell time on single particle inductively coupled plasma mass spectrometry data acquisition quality, Journal of Analytical Atomic Spectrometry, 29:7:1252-1257, (2014).
Laborda, F. et al., Critical considerations for the determination of nanoparticle number concentrations, size and number size distributions by single particle ICP-MS, J. Anal. At. Spectrom, 28:1220-1232, (2013).
Mitrano, D. M. et al., Silver nanoparticle characterization using single particle ICP-MS (SP-ICP-MS) and asymmetrical flow field flow fractionation ICP-MS (AF4-ICP-MS), J. Anal. At. Spectrom., 27:1131-1142, (2012).
Olesik, J. and Gray, P., Considerations for measurement of individual nanoparticles or microparticles by ICP-MS: determination of the number of particles and the analyte mass in each particle, J. Anal. At. Spectrom., DOI: 10.1039/C2JA30073G, (2012).
Pace, H. E. et al., Correction to Determining Transport Efficiency for the Purpose of Counting and Sizing Nanoparticles via Single Particle Inductively Coupled Plasma Mass Spectrometry, Anal. Chem., 84:4633-4633, (2012).
Pace, H. et al., Determining Transport Efficiency for the Purpose of Counting and Sizing Nanoparticles via Single Particle Inductively Coupled Plasma Mass Spectrometry, Analytical Chemistry, 83:24:9361-9369, (2011).
Shigeta, K. et al., Application of micro-droplet generator for an ICP-sector field mass spectrometer—optimization and analytical characterization, Journal of Analytical Atomic Spectrometry, 28:5:645-656, (2012).
Touriniemi, Jani, New single particle methods for detection and characterization of nanoparticles in environmental samples, http://hdl.handle.net/2077/33677, pp. 1-66, (2013).
Tuoriniemi, J. et al., Size Discrimination and Detection Capabilities of Single-Particle ICPMS for Environmental Analysis of Silver Nanoparticles, Anal. Chem., 84:3965-3972, (2012).
Oct. 29, 2018 (JP) Office Action—Application 2016-551843.

* cited by examiner

SYSTEMS AND METHODS FOR AUTOMATED OPTIMIZATION OF A MULTI-MODE INDUCTIVELY COUPLED PLASMA MASS SPECTROMETER

PRIORITY

This application claims priority to and the benefit of U.S. Provisional Patent Application No. 61/940,349, filed Feb. 14, 2014, titled "Systems and Methods for Automated Optimization of a Multi-Mode Inductively Coupled Plasma Mass Spectrometer," the content of which is incorporated by reference herein in its entirety.

TECHNICAL FIELD

This invention relates generally to tuning of mass spectrometry systems. In particular embodiments, the invention relates to automated tuning of multi-mode inductively coupled plasma mass spectrometers (ICP-MS).

BACKGROUND

Mass spectrometry (MS) is an analytical technique for determining the elemental composition of unknown sample substances that has both quantitative and qualitative applications. For example, MS is useful for identifying unknown compounds, determining the isotopic composition of elements in a molecule, and determining the structure of a particular compound by observing its fragmentation, as well as for quantifying the amount of a particular compound in the sample. Mass spectrometers typically operate by ionizing a test sample using one of many different available methods to form a stream of positively charged particles, i.e. an ion stream. The ion stream is then subjected to mass differentiation (in time or space) to separate different particle populations in the ion stream according to mass-to-charge (m/z) ratios. A downstream mass analyzer can detect the intensities of the mass-differentiated particle populations in order to compute analytical data of interest, e.g. the relative concentrations of the different particle's populations, mass-to-charge ratios of product or fragment ions, and other potentially useful analytical data.

In mass spectrometry, ions of interest ("analyte ions") can coexist in the ion stream with other unwanted ion populations ("interferer ions") that have substantially the same nominal m/z ratio as the analyte ions. In some cases, the m/z ratio of the interferer ions, though not identical, will be close enough to the m/z ratio of the analyte ions that it falls within the resolution of the mass analyzer, thereby making the mass analyzer unable to distinguish the two types of ions. Improving the resolution of the mass analyzer is one approach to dealing with this type of interference (commonly referred to as "isobaric" or "spectral interference"). Higher resolution mass analyzers, however, tend to have slower extraction rates and higher loss of ion signals requiring more sensitive detectors. Limits on the achievable resolution may also be encountered.

Beyond spectral interferences, additional non-spectral interferences are also commonly encountered in mass spectrometry. These can derive from neutral metastable species of particles, and produce an elevated background over a range of masses. This elevated background adversely affects the detection limit of the instrument. Some common non-spectral interferences in the ion stream include photons, neutral particles, and gas molecules.

Inductively coupled plasma mass spectrometry (ICP-MS) has been gaining favor with laboratories around the world as the instrument of choice for performing trace metal analysis. ICP-MS instrument detection limits are at or below the single part per billion (ppb) level for much of the periodic table, the analytical working range is nine orders of magnitude, productivity is superior to other techniques, and isotopic analysis can be readily achieved. Most analyses performed on ICP-MS instrumentation are quantitative; however, ICP-MS can perform semi-quantitative analysis as well, identifying an unknown sample for any of 80 detectable, differentiable elements, for example.

In ICP-MS analysis, samples are introduced into an argon plasma as aerosol droplets. The plasma dries the aerosol, dissociates the molecules, then removes an electron from the components, thereby forming singly-charged ions, which are directed into a mass filtering device known as a mass spectrometer. Most commercial ICP-MS systems employ a quadrupole mass spectrometer which rapidly scans the mass range. At any given time, only one mass-to-charge ratio will be allowed to pass through the mass spectrometer from the entrance to the exit. Upon exiting the mass spectrometer, ions strike the first dynode of an electron multiplier, which serves as a detector. The impact of the ions releases a cascade of electrons, which are amplified until they become a measurable pulse. The intensities of the measured pulses are compared to standards, which make up a calibration curve for a particular element, to determine the concentration of that element in the sample.

Most ICP-MS instruments include the following components: a sample introduction system composed of a nebulizer and spray chamber; an ICP torch and RF coil for generating the argon plasma that serves as the ion source; an interface that links the atmospheric pressure ICP ion source to a high vacuum mass spectrometer; a vacuum system that provides high vacuum for ion optics, quadrupole, and detector; a collision/reaction cell that precedes the mass spectrometer and is used to remove interferences that can degrade achievable detection limits; ion optics that guide the desired ions into the quadrupole while assuring that neutral species and photons are discarded from the ion beam; a mass spectrometer that acts as a mass filter to sort ions by their mass-to-charge ratio (m/z); a detector that counts individual ions exiting the quadrupole; and a data handling and system controller that controls aspects of instrument control and data handling for use in obtaining final concentration results.

In an inductively coupled plasma ion source, the end of a torch comprising three concentric tubes, typically quartz, is placed into an induction coil supplied with a radiofrequency electric current. A flow of argon gas can then be introduced between the two outermost tubes of the torch, where the argon atoms can interact with the radio-frequency magnetic field of the induction coil to free electrons from the argon atoms. This action produces a very high temperature (perhaps 10,000 K) plasma comprising mostly argon atoms with a small fraction of argon ions and free electrons. The analyte sample is then passed through the argon plasma, for example as a nebulized mist of liquid. Droplets of the nebulized sample evaporate, with any solids dissolved in the liquid being broken down into atoms and, due to the extremely high temperatures in the plasma, stripped of their most loosely-bound electron to form a singly charged ion.

Thus, the ion stream generated by an ICP ion source often contains, in addition to the analyte ions of interest, a large concentration of argon and argon based spectral interference ions. For example, some of the more common spectral interferences include Ar+, ArO+, Ar2+, ArCl+, ArH+, and MAr+ (where M denotes the matrix metal in which the sample was suspended for ionization), but also may include other spectral interferences such as ClO+, MO+, and the like. Other types of ion sources, including glow discharge and electrospray ion sources, may also produce non-negligible concentrations of spectral interferences. Spectral interferences may be generated from other sources in MS, for example during ion extraction from the source (e.g. due to cooling of the plasma once it is subjected to vacuum pressures outside of the ICP, or perhaps due to interactions with the sampler or skimmer orifices). The momentum boundaries existing at the edges of the sampler or skimmer represent another possible source of spectral interferences.

Aside from using high-resolution mass analyzers to distinguish between analyte and interferer ions, another way of mitigating the effects of spectral interferences in the ion stream is to selectively eliminate the interferer ions upstream of the mass analysis stage. According to one approach, the ion stream can be passed through a cell, sometimes referred to as a reaction cell (e.g., dynamic reaction cell (DRC), as manufactured by PerkinElmer, Inc.), which is filled with a selected gas that is reactive with the unwanted interferer ions, while remaining more or less inert toward the analyte ions. The terms "DRC" and "DRC mode" are used interchangeably herein with the terms "reaction cell" and "reaction cell mode". As the ion stream collides with the reactive gas in the DRC, the interferer ions form product ions that no longer have substantially the same or similar m/z ratio as the analyte ions. If the m/z ratio of the product ion substantially differs from that of the analyte, then conventional mass filtering can then be applied to the cell to eliminate the product interferer ions without significant disruption of the flow of analyte ions. Thus, the ion stream can be subjected to a band pass mass filter to transmit only the analyte ions to the mass analysis stage in significant proportions. Use of a DRC to eliminate interferer ions is described, for example, in U.S. Pat. Nos. 6,140,638 and 6,627,912, the entire contents of which are incorporated herein by reference.

In general, DRC can provide extremely low detection limits, even on the order of parts or subparts per trillion depending on the analyte of interest. For the same isotope, certain limitations or constraints are imposed upon DRC. For one thing, because the reactive gas must be reactive only with the interferer ion and not with the analyte, DRC is sensitive to the analyte ion of interest. Different reactive gases may need to be employed for different analytes. In other cases, there may be no known suitable reactive gas for a particular analyte. In general, it may not be possible to use a single reactive gas to address all spectral interferences.

Another potential constraint is imposed on DRC in the form of the type of cell that can be used. Radial confinement of ions is provided within the cell by forming a radial RF field within an elongated rod set. Confinement fields of this nature can, in general, be of different orders, but are commonly either a quadrupolar field, or else some higher order field, such as a hexapolar or octopolar field. However, DRC may be restricted to use of quadrupolar radial confinement fields if mass filtering is to be applied in the collision cell to eliminate the product interferer ions. Application of small DC voltages to a quadrupole rod set, in conjunction with the applied quadrupolar RF, can destabilize ions of m/z ratios falling outside of a narrow, tunable range, thereby creating a form of mass filter for ions. Comparable techniques for other higher order poles may not be as effective as with the quadrupole rod set. Thus, DRC may be confined to a cell with a quadrupolar field.

According to another approach, which is sometimes referred to as collision cell mode (e.g., kinetic energy discrimination (KED), as manufactured by PerkinElmer, Inc.), the ion stream can be collided inside the collision cell with a substantially inert gas. The terms "KED" and "KED mode" are used interchangeably herein with the terms "collision cell" and "collision cell mode". Both the analyte and interferer ions can be collided with the inert gas causing an average loss of kinetic energy in the ions. The amount of kinetic energy lost due to the collisions is related to the collisional cross-section of the ions, which is related to the elemental composition of the ion. Polyatomic ions (also known as molecular ions) composed of two or more bonded atoms tend to have a larger collisional cross-section than do monatomic ions, which are composed only of a single charged atom. This is due to the atomic spacing between the two or more bonded atoms in the polyatomic ion. Consequently, the inert gas can collide preferentially with the polyatomic atoms to cause, on average, a greater loss of kinetic energy than will be seen in monatomic atoms of the same m/z ratio. A suitable energy barrier established at the downstream end of the collision cell can then trap a significant portion of the polyatomic interferer and prevent transmission to the downstream mass analyzer.

Relative to DRC, KED has the benefit of being generally more versatile and simpler to operate, because the choice of inert gas does not substantially depend on the particular interferer and/or analyte ions of interest. A single inert gas, which is often helium, can effectively remove many different polyatomic interferences of different m/z ratios, so long as the relative collisional cross-sections of the interferer and analyte ions are as described above. At the same time, certain drawbacks may be associated with KED. In particular, KED can have lower ion sensitivity than DRC because some of the reduced energy analyte ions will be trapped, along with the interferer ions, and prevented from reaching the mass analysis state. The same low levels of ions (e.g. parts and subparts per trillion) can therefore not be detected using KED. For example, detection limits can be 10 to 1000 times worse using KED relative to DRC.

To an extent, KED may also be limited in the range of radial confinement fields that can be used within the collision cell. Collisions with the inert gas cause a radial scattering of ions within the rod set. Higher order confinement fields, including hexapolar and octopolar fields, may be preferred because they can provide deeper radial potential wells than quadrupolar fields and therefore may provide better radial confinement. Quadrupolar fields are not strictly required for KED because, unlike in DRC, a mass filter is not usually utilized to discriminate against product interferer ions. In KED, the downstream energy barrier discriminates against the interferer ions in terms of their average kinetic energies relative to that of the analyte ions. Use of the available higher order poles also tends to ease requirements on the quality of ion stream, such as width of the beam and energy distributions of the respective ion populations in the beam, which in turn can ease requirements on other ion optical elements in the mass spectrometer and provide more versatility.

When the IPC-MS system is not operating in either DRC or KED mode, that is, when it is operating in vented cell mode, this is referred to herein as standard (STD) mode. It is beneficial to have an ICP-MS system capable of switching among standard (STD), DRC, and KED modes of operation, so that a user can select the best mode for a particular application, then switch to the desired mode later when performing another application with the instrument. Information regarding ICP-MS systems capable of switching among standard, DRC, and KED modes is described in U.S. Pat. No. 8,426,804, the text of which is incorporated by reference in its entirety. For example, by controlling the ion source and other ion optical elements located upstream of the collision cell, as well as by controlling downstream components such as the mass analyzer to establish a suitable energy barrier, a quadrupole collision cell can be rendered operable for KED. Thus, a single collision cell in the mass spectrometer system can operate in both the DRC mode (reaction mode) and KED mode (collision mode), and the system can also operate in a standard mode (STD) without the dynamic reaction cell and without kinetic energy discrimination. This offers increased application flexibility.

For example, in vented cell mode (e.g., standard "STD" mode), the cell gas of an ICP-MS system is turned "off" and the system works like a non-cell instrument, providing a level of sensitivity equal to collision cell mode (e.g., KED) or reaction cell mode (e.g., DRC) for elements not requiring interference correction. In collision cell mode (e.g., KED), a non-reactive gas is introduced into the cell to collide with interfering ions with larger diameters, reducing their kinetic energy so they may be removed through kinetic energy discrimination (KED). In reaction cell mode (e.g., DRC), a highly reactive gas (or gasses) is introduced into the cell to create predictable chemical reactions. Any side reactions and resulting new interferences can be immediately removed by a scanning quadrupole so that only the element of interest is passed to the analyzing quadrupole and detector.

Tuning, or optimization, of an ICP-MS system is required on a routine basis, e.g., on a daily basis, to ensure accurate and precise operation of the instrument. Tuning procedures for a multi-mode ICP-MS system are complex, because settings need to be adjusted depending on the mode of operation. Heretofore, this has been a primarily manual procedure. Frequent mode switching requires frequent adjustment, requiring more labor to be performed by a specialized operator, reducing productivity.

Although certain ICP-MS allows customized tuning- or optimization-sequences to be programmed, these sequences are static recitations of steps performed by the ICP-MS that merely halt the program when an issue is detected. Thus, the ICP-MS would have to be continuously monitored by a technician when such programs are being executed.

There is a need for an improved tuning optimization procedure for a multi-mode ICP-MS system.

SUMMARY OF THE INVENTION

Described herein are methods and systems for automated tuning of multi-mode inductively coupled plasma mass spectrometers (ICP-MS). In certain embodiments, a 'single click' optimization method is provided for a multi-mode ICP-MS system that automates tuning of the system in one or more modes selected from among the multiple modes, e.g., vented cell mode (also referred to as standard operational mode "STD"), reaction cell mode (also referred to as dynamic reaction cell mode "DRC"), and collision cell mode (also referred to as kinetic energy discrimination mode "KED"). Here, 'single click' refers to a simple user input (e.g., a keystroke) that launches an automated procedure following entry of simple user input specifying, for example, selected mode(s), and, if applicable, choice of cell gas and/or gas flow rate. To this end, the automated procedure obviates the requirement that the operator interact or engage in the tuning or optimization process after the procedure is initiated. The procedure provides a method for tuning the ICP-MS in a comprehensive automated, systematic manner. In some implementations, the system defines one or more minimum detection level or detection levels or detection thresholds as criteria for performance assessment conducted during the tuning (optimization) procedure.

Workflows and computational routines, including a dynamic range optimization technique, are presented that provide faster, more efficient, and more accurate tuning. The routines may be partitioned into multiple levels. For a given tuning procedure, following user initiation, the optimization routine advances from one level to the next, until successful tuning of the ICP-MS has been achieved, as determined by an instrument performance assessment. In some implementations, the automated optimization routine accounts for the frequency that a given subroutine should be run (e.g., daily, monthly, or when there is a hardware change) for optimal instrument performance and/or the expected likelihood that an issue/problem will be detected by the given subroutine.

Failure to satisfy the performance requirements, as determined at the end of a given level of the optimization procedure (and/or at the initiation of the optimization procedure), results in the system advancing to a subsequent level of automated tuning.

In certain embodiments, the method involves implementation of a "quick" performance assessment containing fewer steps than a more complete "full" performance assessment. If the "quick" check is satisfactory, the more complete "full" performance check is performed; and, if the "quick" check is unsatisfactory, the test is considered a "fail," indicating further adjustment is necessary. This serves to speed identification of a failed check, after which the next level of optimization must be performed for further adjustment. In some implementations, the "full" performance assessment employs repeated testing of samples using the same criterion/criteria as the "quick" check (e.g., running a predetermined number of repetitions).

Steps of the automated workflow include, for example, adjustment/alignment of the torch (inductively coupled plasma) relative to the mass spectrometer, quadrupole ion deflector (QID) calibration, quadrupole rod offset (QRO), nebulizer gas flow optimization, cell rod offset (CRO) optimization, cell entrance/exit optimization, mass calibration, and/or detector optimization. These procedures may also involve, for example, the use of analyte-containing standard solutions containing known analyte(s) at known concentration(s). Furthermore, in some implementations, the automatic workflow iteratively repeats one or more steps to improve the performance of the ICP-MS and/or to ensure consistent operation.

Furthermore, a dynamic range optimization technique is provided to expedite identification of values in nebulizer gas flow optimization and/or quadrupole ion deflector (QID) ('autolens') calibration. Previously, a user was required to specify a range in which the optimized setting value would be found during the tuning procedure. This was time consuming, required detailed user knowledge of the system, and resulted in error or required entry of a new range by the user when an optimized position was not found within the specified range. Dynamic range optimization does not require user input—rather, an initial range is automatically specified, which may be a predetermined range around the most recent optimized position. The tuning routine is performed using the automatically specified range. If the optimization criteria are not met within this initial range, a new range is identified, for example, by automatically shifting the previous range in a direction of improved performance. The procedure continues in this manner, identifying a new range when the previous range is found not to contain an optimized value. The tuning step is complete when an optimized value is identified within the tested range.

Also presented herein is an improved technique for optimization of cell rod offset (CRO), quadrupole ion deflector (QID) ('autolens'), and/or other settings in the automated workflow involving normalization of intensities identified using multiple analytes. For example, an optimized setting (position) for CRO is identified by normalizing pulse intensities obtained over a range of deflector voltages, for each of a plurality of analytes. The plurality of analytes may include, e.g., an analyte of comparatively low mass, an analyte of medium mass, and an analyte of higher mass. The pulse intensities are normalized by the maximum intensity value for the respective analyte, then these normalized values are multiplied by their respective deflector voltage. The highest value among all the analytes is identified as the best compromised point and is used to identify the optimized setting value (e.g., CRO).

Also presented herein is a 'smart sampling' technique for automatically identifying the need for a change of analyte solution to be used during optimization. By loading an autosampler with the analyte solution(s) that may be needed, prior to initiation of the single-click optimization routine, it is not required that a user be present throughout the optimization process, thereby improving operator productivity.

In one aspect, the invention is directed to a system for automated optimization (tuning) of a multi-mode inductively coupled plasma mass spectrometer (ICP-MS). The system includes a multi-mode inductively coupled plasma mass spectrometer (ICP-MS), a processor, and a non-transitory computer readable medium that stores instructions thereon. The instructions, when executed, cause the processor to receive user data input regarding an optimization to be performed on the ICP-MS where the user data input includes an identification of one or more selected modes of operation in which the ICP-MS is to be operated. In some implementations, the one or more modes includes one, two, or all three of: (a) a vented cell mode, (b) a reaction cell mode, e.g., dynamic reaction cell "DRC" mode, and (c) a collision cell mode, e g, kinetic energy discrimination "KED" mode. The instructions, when executed, further cause the processor to receive a user input for initiating an automated optimization routine for the ICP-MS. In some implementations, the user input for initiating the routine includes a 'single click', a keystroke, a swipe, selection of a graphical user interface widget, or any other user input, delivered via a user interface device, e.g., a keyboard, a mouse, or any other UI device. The instructions, when executed, further cause the processor to, following receipt of the user input for initiating the routine, transmit a signal to the ICP-MS to perform the automated optimization routine. The automated optimization routine includes one or more steps performed in a sequence prescribed by the processor.

In certain embodiments, the automated optimization routine includes an ICP-MS performance assessment subsequence. The subsequence includes the steps of automatically conducting a first performance assessment (e.g., 'quick' assessment), then, if the first assessment is satisfactory, conducting a second performance assessment (e.g., 'full' assessment). Else, if the first assessment is unsatisfactory, the routine ends the subsequence and identifies the performance assessment as failed where the first performance assessment contains fewer steps and is less time consuming to conduct than the second performance assessment. In some embodiments, "fewer steps" means fewer prescribed repetitions of identical steps and/or fewer unique steps.

In certain embodiments, the automated optimization routine includes one or more levels. Each level has steps associated therewith where the routine is programmed to proceed from a given level to a subsequent level if a performance assessment subsequence performed at the conclusion of the preceding steps in the given level is identified as failed. Else, if the performance assessment subsequence performed at the conclusion of the preceding steps in the given level is identified as satisfactory, the routine is programmed to end the optimization.

In certain embodiments, the automated optimization routine includes one or more steps selected from the group consisting of (i) adjustment/alignment of the torch (inductively coupled plasma) relative to the mass spectrometer, (ii) quadrupole ion deflector (QID) calibration, (iii) quadrupole rod offset (QRO), (iv) nebulizer gas flow optimization, (v) cell rod offset (CRO) optimization, (vi) cell entrance and/or exit optimization, (vii) mass calibration, and (viii) detector optimization.

In certain embodiments, the automated optimization routine includes one or both of (i) a nebulizer gas flow optimization step, and (ii) a quadrupole ion deflector (QID) calibration step. The optimization routine includes a dynamic range optimization subsequence associated with steps (i) and/or (ii) where the dynamic range optimization subsequence includes initiating the associated optimization step by adjusting an associated setting within a predetermined initial range determined from a stored value (e.g., stored on a non-transitory computer-readable medium) of the setting identified in a previous optimization of the ICP-MS (e.g., within a range of predetermined size about the previously-determined optimized value). Where optimization criteria are not met within the predetermined initial range, the routine includes automatically identifying a new range in a direction of improved performance and continuing to identify subsequent new ranges until the optimization criteria are met. The corresponding setting is then recorded for later use (e.g., recording on the non-transitory computer-readable medium).

In certain embodiments, the automated optimization routine includes one or both of (i) a cell rod offset (CRO) step, and (ii) a cell entrance/exit step. The optimization routine includes a normalization subroutine associated with steps (i) and/or (ii) where the normalization subroutine includes identifying an optimized setting associated with the step by normalizing pulse intensities determined from the ICP-MS over a range of voltages, for each of a plurality of analytes (e.g., a first analyte of comparatively low mass, a second analyte of comparatively greater mass, and a third analyte of comparatively still greater mass). The routine then uses the normalized values to identify the optimized setting. In certain embodiments, the normalization subroutine includes the step of multiplying the normalized values at the respective voltage and identifying a best compromised point from the result, thereby identifying the optimized setting.

In certain embodiments, the system further includes an autosampler where the automated optimization routine includes a smart sampling subroutine. The subroutine includes (i) the step of identifying, during the optimization routine, if and when use of a first analyte solution should be discontinued and use of a second analyte solution be initiated, and (ii) upon identification that the first analyte solution should be discontinued and use of the second analyte solution be initiated, transmitting a signal to initiate automated introduction of the second analyte solution in the optimization routine of the ICP-MS via the autosampler. In certain embodiments, if no autosampler is connected, the system generates a message when a solution change is required.

In certain embodiments, the automated optimization routine includes the step of rendering, by the processor, for presentation on a graphical user interface (e.g., an electronic screen), graphical and/or alphanumeric output representing one or more steps being performed in the automated optimization routine. In certain embodiments, the automated optimization routine includes the step of displaying the graphical and/or alphanumeric output on the graphical user interface in real time as the corresponding one or more step(s) are being performed during the automated optimization routine.

In certain embodiments, the user data input regarding the optimization further includes an indication of cell gas flow rate.

In another aspect, the invention is directed to a method for automated optimization (tuning) of a multi-mode inductively coupled plasma mass spectrometer (ICP-MS). The method includes receiving, by a processor of a computing device, user data input regarding an optimization to be performed on a multi-mode inductively coupled plasma mass spectrometer (ICP-MS) where the user data input includes an identification of one or more selected modes of operation in which the ICP-MS is to be operated. In some implementations, the one or more modes includes one, two, or all three of: (a) a vented cell mode, (b) a reaction cell mode, e.g., dynamic reaction cell "DRC" mode, and (c) a collision cell mode, e.g., kinetic energy discrimination "KED" mode.

The method includes receiving, by the processor, a user input for initiating an automated optimization routine for the ICP-MS. In some implementations, the user input for initiating the routine includes a 'single click', a keystroke, a swipe, selection of a graphical user interface widget, or any other user input, delivered via a user interface device, e.g., a keyboard, a mouse, or any other UI device.

The method includes, following receipt of the user input for initiating the routine, transmitting, by the processor, a signal to the ICP-MS to perform the automated optimization routine where the automated optimization routine includes steps performed in a sequence prescribed by the processor.

In certain embodiments, the method further includes performing the automated optimization routine. In certain embodiments, the automated optimization routine includes automatically adjusting one or more settings of the ICP-MS during the automated optimization routine.

In certain embodiments, the automated optimization routine includes an ICP-MS performance assessment subsequence. The subsequence includes the steps of automatically conducting a first performance assessment (e.g., 'quick' assessment), then, if the first assessment is satisfactory, conducting a second performance assessment (e.g., 'full' assessment). Else, if the first assessment is unsatisfactory, the subsequence ends and identifies the performance assessment as failed. The first performance assessment contains fewer steps and is less time consuming to conduct than the second performance assessment. In certain embodiments, the automated optimization routine includes a plurality of levels. Each level has steps associated therewith where the routine is programmed to proceed from a given level to a subsequent level if a performance assessment subsequence performed at the conclusion of the preceding steps in the given level is identified as failed Else, if the performance assessment subsequence performed at the conclusion of the preceding steps in the given level is identified as satisfactory, the routine is programmed to end the optimization.

In certain embodiments, the automated optimization routine includes one or more steps selected from the group consisting of (i) adjustment/alignment of the torch (inductively coupled plasma) relative to the mass spectrometer, (ii) quadrupole ion deflector (QID) calibration, (iii) quadrupole rod offset (QRO), (iv) nebulizer gas flow optimization, (v) cell rod offset (CRO) optimization, (vi) cell entrance and/or exit optimization, (vii) mass calibration, and (viii) detector optimization.

In certain embodiments, the automated optimization routine includes one or both of (i) a nebulizer gas flow optimization step, and (ii) a quadrupole ion deflector (QID) calibration step, said optimization routine comprising a dynamic range optimization subsequence associated with steps (i) and/or (ii). The dynamic range optimization subsequence includes initiating the associated optimization step by adjusting an associated setting within a predetermined initial range determined from a stored value (e.g., stored on a non-transitory computer-readable medium) of the setting identified in a previous optimization of the ICP-MS (e.g., within a range of predetermined size about the previously-determined optimized value). Where the optimization criteria are not met within the predetermined initial range, the subsequence includes automatically identifying a new range in a direction of improved performance and continuing to identify subsequent new ranges until the optimization criteria are met. The corresponding setting is then recorded for later use (e.g., recording on the non-transitory computer-readable medium).

In certain embodiments, the automated optimization routine includes one or both of (i) a cell rod offset (CRO) step, and (ii) a cell entrance/exit step. The optimization routine includes a normalization subroutine associated with steps (i) and/or (ii). The normalization subroutine includes identifying an optimized setting associated with the step by normalizing pulse intensities determined from the ICP-MS over a range of voltages, for each of a plurality of analytes (e.g., a first analyte of comparatively low mass, a second analyte of comparatively greater mass, and a third analyte of comparatively still greater mass). The normalization subroutine uses the normalized values to identify the optimized setting. In certain embodiments, the normalization subroutine further includes the step of multiplying the normalized values at the respective voltage and identifying a best compromised point from the result, thereby identifying the optimized setting.

In certain embodiments in which the ICP-MS employs an autosampler, the automated optimization routine includes a smart sampling subroutine that includes (i) the step of identifying, during the optimization routine, if and when use of a first analyte solution should be discontinued and use of a second analyte solution be initiated, and (ii) upon identification that the first analyte solution should be discontinued and use of the second analyte solution be initiated, transmitting a signal to initiate automated introduction of the second analyte solution in the optimization routine of the ICP-MS via the autosampler.

In certain embodiments, the method includes rendering, by the processor, for presentation on a graphical user interface (e.g., an electronic screen), graphical and/or alphanumeric output representing one or more steps being performed in the automated optimization routine. In certain embodiments, the method includes displaying the graphical and/or alphanumeric output on the graphical user interface in real time as the corresponding one or more step(s) are being performed during the automated optimization routine.

In certain embodiments, the user data input regarding the optimization further comprises an indication of cell gas flow rate.

In another aspect, the invention is directed to a non-transitory computer readable medium having instructions stored thereon, wherein the instructions, when executed by a processor, cause the processor to receive user data input regarding an optimization to be performed on a multi-mode inductively coupled plasma mass spectrometer (ICP-MS). The user data input includes an identification of one or more selected modes of operation in which the ICP-MS is to be operated. In some implementations, the one or more modes includes one, two, or all three of: (a) a vented cell mode, (b) a reaction cell mode, e.g., dynamic reaction cell "DRC" mode, and (c) a collision cell mode, e.g., kinetic energy discrimination "KED" mode.

The instructions, when executed, further cause the processor to receive a user input for initiating an automated optimization routine for the ICP-MS. In some implementations, the user input for initiating the routine includes a 'single click', a keystroke, a swipe, selection of a graphical user interface widget, or any other user input, delivered via a user interface device, e.g., a keyboard, a mouse, or any other UI device.

The instructions, when executed, further cause the processor to, following receipt of the user input for initiating the routine, transmit a signal to the ICP-MS to perform the automated optimization routine where the automated optimization routine includes one or more steps performed in a sequence prescribed by the processor.

In certain embodiments, the automated optimization routine includes an ICP-MS performance assessment subsequence. The subsequence includes the steps of automatically conducting a first performance assessment (e.g., 'quick' assessment), then, if the first assessment is satisfactory, conducting a second performance assessment (e.g., 'full' assessment). Else, if the first assessment is unsatisfactory, the subsequent ends the subsequence and identifies the performance assessment as failed. The first performance assessment contains fewer steps and is less time consuming to conduct than the second performance assessment. In certain embodiments, the automated optimization routine includes a plurality of levels. Each level has steps associated therewith where the routine is programmed to proceed from a given level to a subsequent level if a performance assessment subsequence performed at the conclusion of the preceding steps in the given level is identified as failed. Else, if the performance assessment subsequence performed at the conclusion of the preceding steps in the given level is identified as satisfactory, the routine is programmed to end the optimization.

In certain embodiments, the automated optimization routine includes one or more steps selected from the group consisting of (i) adjustment/alignment of the torch (inductively coupled plasma) relative to the mass spectrometer, (ii) quadrupole ion deflector (QID) calibration, (iii) quadrupole rod offset (QRO), (iv) nebulizer gas flow optimization, (v) cell rod offset (CRO) optimization, (vi) cell entrance and/or exit optimization, (vii) mass calibration, and (viii) detector optimization.

In certain embodiments, the automated optimization routine includes one or both of (i) a nebulizer gas flow optimization step, and (ii) a quadrupole ion deflector (QID) calibration step. The optimization routine includes a dynamic range optimization subsequence associated with steps (i) and/or (ii) where the dynamic range optimization subsequence includes initiating the associated optimization step by adjusting an associated setting within a predetermined initial range determined from a stored value (e.g., stored on a non-transitory computer-readable medium) of the setting identified in a previous optimization of the ICP-MS (e.g., within a range of predetermined size about the previously-determined optimized value). Where the optimization criteria are not met within the predetermined initial range, the optimization subsequence includes automatically identifying a new range in a direction of improved performance and continuing to identify subsequent new ranges until the optimization criteria are met. The corresponding setting is then recorded for later use (e.g., recording on the non-transitory computer-readable medium).

In certain embodiments, the automated optimization routine includes one or both of (i) a cell rod offset (CRO) step, and (ii) a cell entrance/exit step. The optimization routine includes a normalization subroutine associated with steps (i) and/or (ii). The normalization subroutine includes identifying an optimized setting associated with the step by normalizing pulse intensities determined from the ICP-MS over a range of voltages, for each of a plurality of analytes (e.g., a first analyte of comparatively low mass, a second analyte of comparatively greater mass, and a third analyte of comparatively still greater mass). The normalization subroutine then uses the normalized values to identify the optimized setting.

In certain embodiments, the normalization subroutine further includes the step of multiplying the normalized values at the respective voltage and identifying a best compromised point from the result, thereby identifying the optimized setting.

In certain embodiments in which the ICP-MS includes an autosampler, the automated optimization routine includes a smart sampling subroutine that includes (i) the step of identifying, during the optimization routine, if and when use of a first analyte solution should be discontinued and use of a second analyte solution be initiated, and (ii) upon identification that the first analyte solution should be discontinued and use of the second analyte solution be initiated, transmitting a signal to initiate automated introduction of the second analyte solution in the optimization routine of the ICP-MS via the autosampler.

In certain embodiments, the automated optimization routine includes the step of rendering, by the processor, for presentation on a graphical user interface (e.g., an electronic screen), graphical and/or alphanumeric output representing one or more steps being performed in the automated optimization routine. In certain embodiments, the automated optimization routine includes the step of displaying the graphical and/or alphanumeric output on the graphical user interface in real time as the corresponding one or more step(s) are being performed during the automated optimization routine.

In certain embodiments, the user data input regarding the optimization further includes an indication of cell gas flow rate.

Elements of embodiments described with respect to a given aspect of the invention may be used in various embodiments of another aspect of the invention. For example, it is contemplated that features of dependent claims depending from one independent claim can be used in apparatus and/or methods of any of the other independent claims.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

DETAILED DESCRIPTION

It is contemplated that systems, devices, methods, and processes of the claimed invention encompass variations and adaptations developed using information from the embodiments described herein. Adaptation and/or modification of the systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

Figure 1:
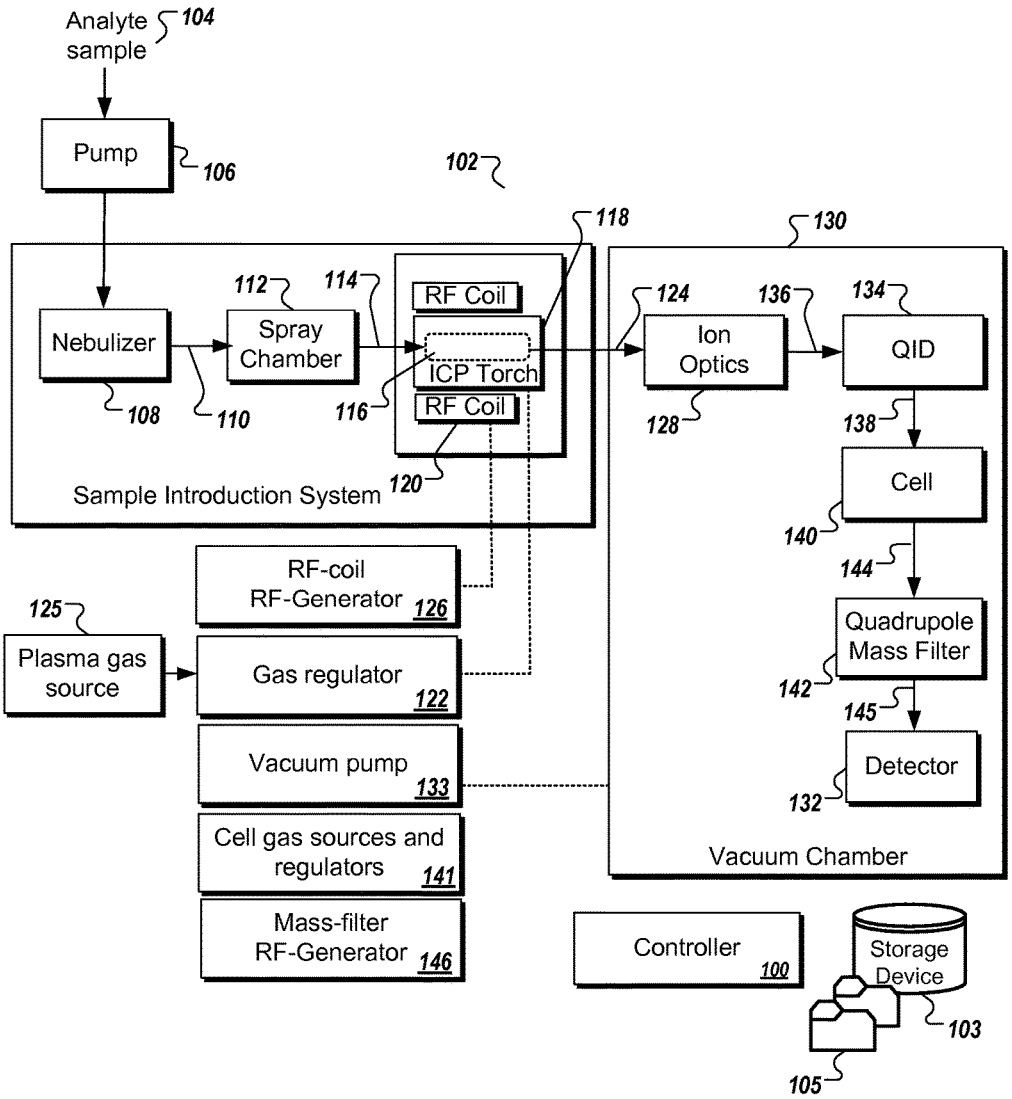
FIG. 1 is a block diagram representing a multi-mode ICP-MS system, according to an illustrative embodiment of the invention.

FIG. 1 is a block diagram representing a multi-mode ICP-MS system, according to an illustrative embodiment. In FIG. 1, the ICP-MS system 102 includes a sample introduction system to receive an analyte sample 104. The analyte sample 104 is preferably a liquid or dispensed in a liquid, though, in some embodiments, the analyte sample is a solid.

In some embodiments, the analyte sample 104 is introduced, for example, by a peristaltic pump 106 or through self-aspiration to a nebulizer 108 to transform the analyte sample into an aerosol of fine droplets 110. Examples of the nebulizer 108 may include, but are not limited to, concentric, cross-flow, Babington, V-Groove, HEN ("high-efficiency"), and MCN ("micro-concentric") nebulizers.

The fine droplets 110 generated by the nebulizer 108 may be passed through a spray chamber 112 to allow only fine droplets 114 that are below certain sizes to enter a plasma 116, typically composed of argon, generated by an ICP torch 118 and RF coil 120. Upon entering the plasma 116, the fine droplets 114 are dried and heated until the fine droplets 114 turn into a gas. As the atoms of the heated gas 114 continue to travel through the plasma 116, they absorb energy from the plasma 116 and form singly charged ions. The charged ions 124 exit the plasma 116 and are directed, as an ion beam 124, to an ion optics assembly 128.

Examples of the spray chamber 112 include, but are not limited to, Scott or Cyclonic chambers. The plasma gas (e.g., argon) may be introduced by a gas regulator 122 that is coupled to a plasma gas source 125. In some implementations, the ICP torch 118 includes a series of concentric quartz tubes that are enveloped by the RF coil 120. In some embodiments, the RF coil 120 is coupled to and energetically supplied by a RF generator 126.

The ion optics assembly 128 provides an interface to the plasma 116. In some implementations, the ion optics assembly 128 includes a series of inverted cones having an orifice to allow the passage of the ion beam 124 while maintaining a high-vacuum environment within a vacuum chamber 130. The vacuum environment reduces the chances that ions of the ion beam 124 would inadvertently collide with gas molecules between the ion optic assembly 128 and the detector 132. In some implementations, the vacuum chamber 130 is coupled to one or more vacuum pumps 133 such as, for example, a turbo-molecular pump and a mechanical roughing pump that operate together to provide the high-vacuum environment. In some implementations, the vacuum pump 133, and/or another pump, may be employed to evacuate the interface region of the ion optic assembly 128.

In some embodiments, the ICP-MS system 102 includes a quadrupole ion deflector (QID) 134 that allows only ions of a specified mass range to pass into the cell 140 and prevents (or substantially reduces) the passage of non-ionized materials, such as neutrals and photons. The QID 134 is configured to filter the non-ionized materials that can cause measurement drifts or degrade the detection limits of the analyte ions of interest. Non-ionized material may be erroneously counted as ions by the detectors 132.

In some implementations, the QID 134 includes a number of rods, which may be a magnetic or an electromagnetic source, configured to turn the direction of the ion beam 136 received from the ion optic assembly 128 to disaggregate (i.e., filter) the ionized portion of the beam 138 (which includes the analyte ions) from the non-ionized portion of the beam (e.g., neutrals, photons, and other non-ionized particles). Alternatively, in certain implementations, an auto-lens assembly is employed.

In some embodiments, the ICP-MS system 102 includes one or more collision and/or reaction cells. In some implementations, the collision or reaction cell may be integrated as a universal cell 140, and may be operated as either a reaction cell chamber or a collision cell chamber, depending on the selected mode of operation of the ICP-MS. The universal cell 140 may couple to one or more gas sources 141 that provide(s) pressurized gas to the cell chamber to react with interferer ionic species in the ion stream 138. The universal cell 140 may optionally include an energy barrier, which may be energized, such as during the operation of the ICP-MS system 102 in collision mode, to further distinguish high-energy analyte ions (ions of interest) from interferent lower-energy ions. The universal cell 140 may include a quadrupole rod set within its interior spacing. The quadrupole rod set may be linked to a voltage source to receive a RF voltage suitable for creating a quadrupolar field.

In certain embodiments, following contact of the ionized sample stream with the reaction gas stream in the cell 140, the resulting product stream 144 is directed to a mass analyzer 142 and detector 132 for detection and/or quantification of analyte ionic species.

In some embodiments, the ICP-MS system 102 includes a mass spectrometer, such as a quadrupole mass spectrometer 142, to separate singly charged ions from each other by mass. For each measurement, the quadrupole mass spectrometer 142 restricts the passage of the ions to only one mass-charge (m/z) ratio (e.g., pre-specified m/z ratio) associated with a given ion in the ion beam 144. In some implementations, time-of-flight or magnetic sector mass spectrometer may be employed. The quadrupole mass spectrometer 142 may couple with a RF generator 146 that provides RF power at specified voltages and frequencies. The quadrupole mass spectrometer 142 may employ both direct current and alternating current electrical fields to separate the ions.

Subsequent to the quadrupole mass spectrometer 142, the detector 132 receives the mass-filtered ions 145 and produces an electronic signal that corresponds to the number of detected analyte ionic species. The detector 132 may couple to a signal processing and amplification circuitries to process the measured signal. The detector 132 counts the total signal for each mass charge, which may be aggregated to form a mass spectrum. The magnitude of the measured intensity values may be scaled based on a calibration standard such that the outputs are provided on a scale proportional to the concentration of the elements or analyte ions.

In some embodiments, the ICP-MS system 102 includes one or more controllers 100 to operate and monitor the operation of the quadrupole mass filter 142, the ignition of the plasma 116 by the ICP torch 118 and the RF coil 120, the pressure regulation of the vacuum chamber 130, the operation of the universal cell 140, and/or the operation of the quadrupole ion deflector 134, among other functions. The controller 100 may operatively connect to a computer-readable medium 103 (shown as storage device 103) that includes instructions 105 for the automated optimization routine.

Figure 2:
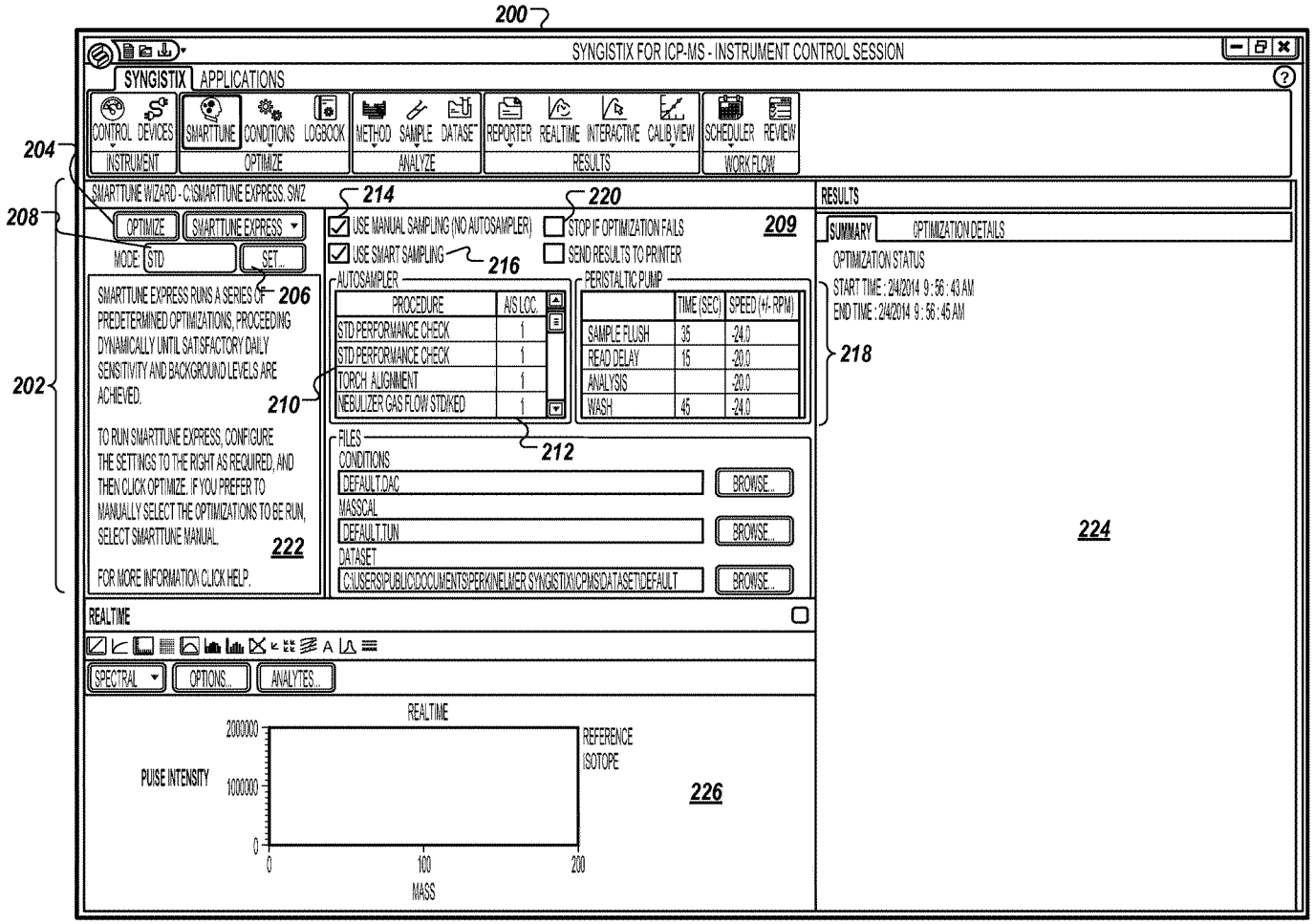
FIG. 2 is an illustration of a graphical user interface (GUI) for automatic tuning of a multi-mode ICP-MS system, according to an illustrative embodiment of the invention.

FIG. 2 illustrates an example graphical user interface (GUI) 200 for automated optimization of a multi-mode ICP-MS system 102, according to an illustrative embodiment. In some implementations, the GUI 200 provides an interface 202 to configure and initiate the automated optimization operation of the multi-mode ICP-MS system 102. The interface 202 may include a graphical input widget 204 to receive a user input to initiate the automated optimization routine.

The automated optimization routine may tune, configure, and/or optimize one or more operational modes associated with the ICP-MS system 102. The interface 202 may initiate one or more pre-determined tuning and/or optimization routines, which proceeds dynamically and continuously until a satisfactory sensitivity, detection, or background level is achieved. To this end, the interface 202 may be configured to allow the user to singularly 'click' on the graphical input widget 204 to initiate the automated optimization routine.

The interface 202 may include an input 206 to allow the user to select and/or change a given operational mode of the ICP-MS system 102. In some implementations, the modes include the vented cell mode, the collision cell mode (e.g., "KED"), and reaction cell mode (e.g., "DRC"). The interface 202 may display, via a widget 208, the selected mode of operation. The selected mode corresponds to the mode that would be optimize when widget 204 is initiated.

Figure 3:
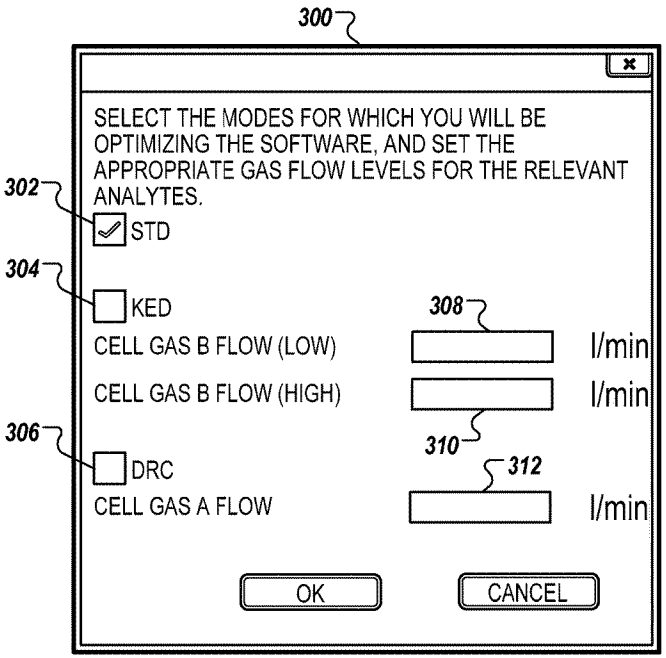
FIG. 3 illustrates an example GUI dialog box for selecting and configuring a mode for automatic tuning of a multi-mode ICP-MS system, according to an illustrative embodiment of the invention.

When switching among modes, the interface 200 may prompt the user for configuration settings for a selected mode. FIG. 3 illustrates an exemplary graphical user interface (GUI) 300 for selecting and configuring one or more modes for automated optimization of a multi-mode ICP-MS system 102, according to an illustrative embodiment. In some implementations, the interface 300 is presented as a dialogue box.

The interface 300 includes one or more inputs to allow the user to select the operational mode of the ICP-MS system 102, including an input 302 for vented cell mode (shown as "STD 302"), an input 304 for collision mode (shown as "KED 304"), and an input 306 for reaction cell mode (shown as "DRC 306").

The interface 300 may further allow the user to configure the appropriate cell gas flow rate, or range of flow rate, for the universal cell 140 for the respective operational modes. As shown, the interface 300 provides, for the collision cell mode, an input 308 for a low flow-rate and an input 310 for a high flow-rate. The interface 300 may provide, for the reaction cell mode, a flow rate input 312. In some implementations, where multiple gas sources are available, the graphical user interface 300 allows the end-use to select the gas source.

Turning back to FIG. 2, the interface 202 may include an auxiliary panel 209 to allow the user to customize the tuning and/or optimization routine. A user can choose, for example, to set up an autosampler or to use manual optimization, elect whether to use smart sampling, select file locations, set sample location and define gas flow.

As shown in FIG. 2, the interface 200 includes an input 214 to allow the user to select between using an autosampler or using manual sampling. When using an autosampler or other multi-purpose sampling systems of standard analytes, the auxiliary panel 209 displays a candidate list 210 of subroutines to be performed (or components of the ICP-MS system 102 to be tuned/optimized) by the automated optimization routine. Examples of such subroutines are provided in Table 1. The controller 100 may skip or omit one or more of these subroutines once a minimum detection level or detection threshold has been achieved.

As shown in FIG. 2, the interface 200 includes one or more windows (222, 224, 226) to display the status and results of the automated optimization routine. Instructional and status information of the current subroutine are displayed in window 222. Summarized results and optimization criteria of each of the subroutine are displayed in window 224 as a log of the tuning and/or optimization process. Data of each of the measurements captured for a given subroutine are displayed in window 226 as a table or graphical plot. The outputs of the windows 222, 224, 226 are stored in one or more files, which may be specified by the user, and may be transmitted as an output to a printer.

An exemplary automated optimization routine is now described.

FIG. 5 (shown across FIGS. 5A-5D) is a flowchart of an exemplary routine 500 for the automated optimization of a multi-mode ICP-MS system 102, according to an illustrative embodiment. The routine in FIGS. 5A-5D may be used in the vented cell (STD) mode, the reaction cell (DRC) mode, and/or the collision cell (KED) mode.

As described in Table 1, the automated optimization routine 500 may optimize the alignment of the ICP torch 118; optimize the gas flow of the nebulizer 108; optimize the operation of the quadrupole mass filter 142, e.g., the quadrupole rod offset (QRO); optimize the operation of the QID 134, e.g., the cell rod offset (CRO); optimize the operation of the cell 140, e.g., entrance/exit filter, make-up gas, gas flow; calibrate the quadrupole mass filter 142; and/or optimize the detector 132. The routines may be partitioned into tiered levels. A summary of the levels, in some implementations, is provided in Table 2.

TABLE 1

Example subroutines of an automated optimization routine

| Procedures | Operation |
|---|---|
| Torch Alignment/Adjustment (e.g., background and sensitivity performance check) | Perform X-Y adjustments of the torch with the ion optics |
| Nebulizer Gas Flow Optimization | Optimize the gas flow if operating in either the standard or dynamic reactive cell mode |
| QID Calibration | Optimize the voltage output of the QID power supply (to optimize the deflection field in the QID) |
| Cell Rod Offset | Adjust voltages and/or energized levels of the cell rod of the universal cell |
| Cell Entrance/Exit Voltage | Adjust voltages and/or energized levels of the cell entrance and/or exit of the universal cell |
| Mass Calibration | Calibrate the mass spectrometer |
| Detector Voltages | Optimize the voltages for either or both the pulse and analog stages to improve the detector's performance |
| Dual Detector Calibration | Ensure that the multi-stages of the detector provide linear responses over the system's dynamic range |

It should be understood that the provided examples are merely illustrative. Other routines may be employed depending on the configuration of the instrument. For example, in some implementations, rather than a QID 134, the ICP-MS system 102 may be equipped with an autolens assembly to perform similar or like functionality. To this end, the automatic optimization and/or tuning routine may include, but not limited to, varying the operations of the autolens assembly.

Still referring to FIG. 2, when the manual-sampling mode is selected, the controller 100 is configured to prompt the user to aspirate each optimization solution at respective test points during the optimization routine.

TABLE 2

Example levels of a subroutine in an automated optimization routine

| Levels | ICP Component |
|---|---|
| Level 1 | Torch/ion optics assembly<br>Nebulizer<br>QID |
| Level 2 | Universal Cell<br>QID<br>Nebulizer |

TABLE 2-continued

| Example levels of a subroutine in an automated optimization routine | |
|---|---|
| Levels | ICP Component |
| Level 3 | Quadrupole mass filter |
| Level 4 | Detector |

Each of the levels may be preceded and/or followed by an evaluative check of the sensitivity of the measurement thereby allowing the routine to proceed through each of the subroutines without interaction from the user When a sub-routine fails to meet a predetermined criteria, or when the ICP-MS system 102 fails to meet a pre-defined measurement of a calibration standard solution, the controller 100 proceeds to the next routine or level. The levels may be partitioned based on a frequency that a given sub-routine should be run or the likelihood that an issue with the subsystem is expected.

Figure 5A:
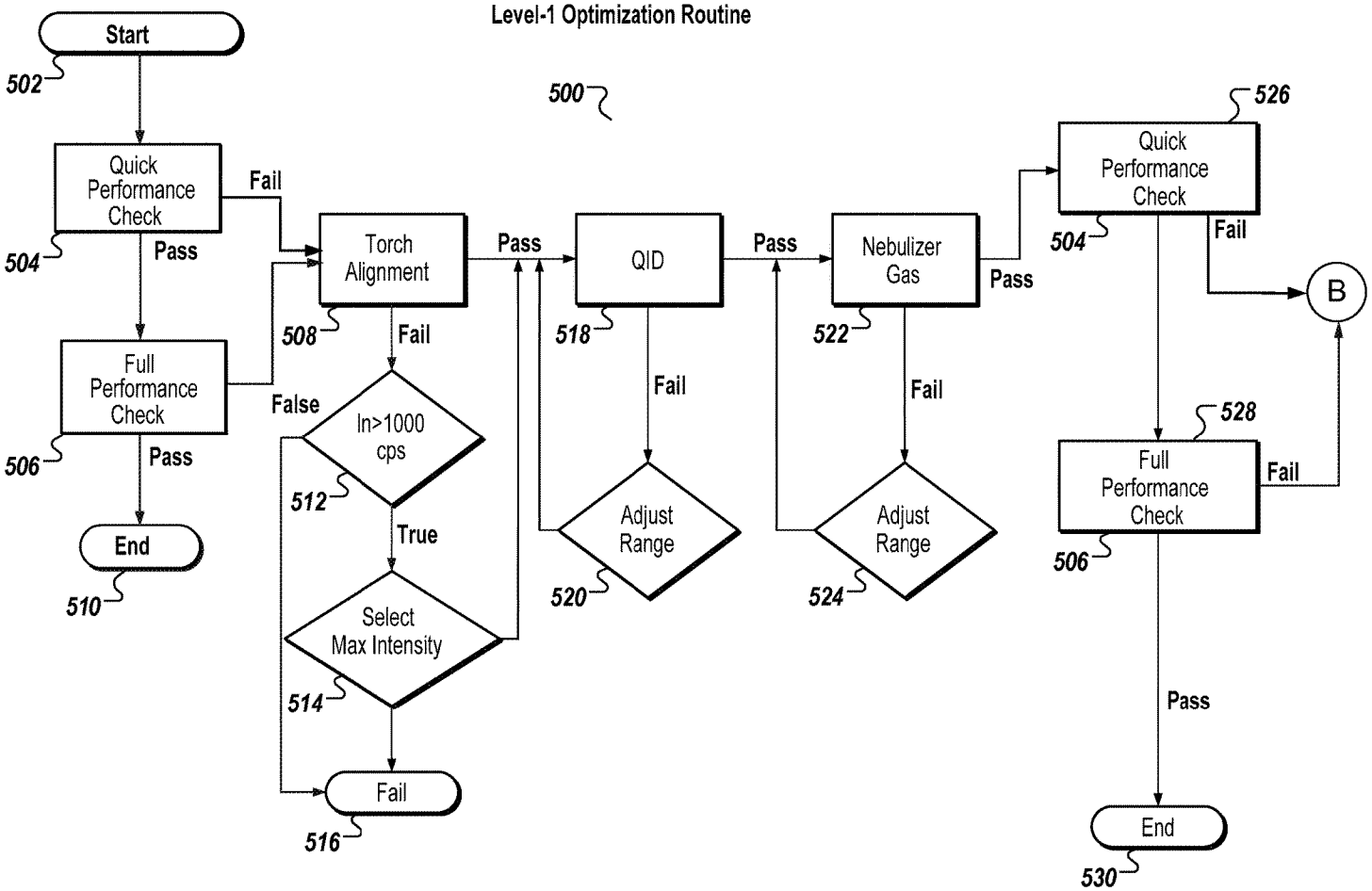
FIG. 5A is a flow chart of a Level-1 optimization routine of a method for automatic optimization of a multimode ICP-MS system (e.g., used in a vented cell (STD) mode, a reaction cell (DRC) mode, and/or a collision cell (KED) mode), according to an illustrative embodiment of the invention.

Now turning to FIG. 5A, the automated optimization routine 500 is initiated, shown at step 502, upon a selection of the graphical input widget 204. The controller 100 may initially perform a preliminary evaluative-check routine 504, shown as "Quick Performance Check 504." The term "preliminary evaluative-check routine" also refers to a 'quick' performance assessment.

A preliminary evaluative-check routine is a fast data acquisition method that compares the sensitivity versus instrument performance specifications provided by the manufacturer for each instrument type. If the instrument meets the specification, then it will proceed to the 'full' performance check. If the instrument fails to meet the specification, it will enter Level-1 optimization. Example criteria of the performance specification are provided in Table 3.

TABLE 3

| Example criteria of a preliminary evaluative routine for vented cell (STD) mode | |
|---|---|
| Intensity Criterion: | $^{9}Be > {}^{9}Be_{threshold}$ |
| Intensity Criterion: | $^{115}In > {}^{115}In_{threshold}$ |
| Intensity Criterion: | $^{238}U > {}^{238}U_{threshold}$ |
| Formula Criterion: | $^{70}Ce^{++}/{}^{140}Ce \leq {}^{70}Ce^{++}{}_{ratio_threshold}$ |
| Formula Criterion: | $^{156}CeO/{}^{140}Ce \leq {}^{156}CeO_{ratio_threshold}$ |

As shown in Table 3, the preliminary evaluative-check routine 504 may evaluate one or more analyte, such as Beryllium ($^{9}Be$); Indium ($^{115}In$); Uranium ($^{238}U$). The measured signal intensity value is presented in counts per second. The routine 504 may include comparing the measured signal intensity value to a predefined threshold (namely, $^{9}Be_{threshold}$, $^{115}In_{threshold}$, and $^{238}U_{threshold}$). For $^{9}Be$, $^{115}In$, $^{238}U$, these thresholds may be 4000, 55000, and 35000, respectively.

The preliminary evaluative-check routine 504 may also be based on evaluations of relationships between measured signals. As shown in Table 3, the routine 504 may include comparing a ratio between two measurements (e.g., $^{70}Ce^{++}/{}^{140}Ce$ or $^{156}CeO/{}^{140}Ce$) to a predefined threshold (e.g., $^{70}Ce^{++}{}_{ratio\ \ threshold}$ or $^{156}CeO_{ratio_threshold}$). The $^{70}Ce^{++}{}_{ratio\ threshold}$ and $^{156}CeO_{ratio_threshold}$ may be represented in percentages (e.g., 3% and 2.5%, respectively) Other elements, formulas, and threshold levels may be employed as part of the preliminary evaluative-check routine 504. In certain embodiments, the evaluative check routine of Table 3 is performed only for operation in STD mode. In certain embodiments, the evaluative check routine of Table 3 is also performed for operation in KED mode and/or in DRC mode. There may be additional (or different) evaluative check routines performed for operation of the instrument in KED mode and/or DRC mode.

In some implementations, the criteria for the preliminary evaluative routine 504 are included in an editable configuration file, which is read by the controller 100 to configure the automated optimization routine. The configuration file may be selected from a collection of configuration files that is accessible (e.g., remotely or locally) to the user.

The automated optimization routine 500 may include procedures to start-up the ICP-MS system 102. In some implementations, these procedures include turning "on" the installed gases and the cooling system, verifying sufficient pressure of the installed gases, regulating the torch gas pressure, regulating the pressure of the vacuum chamber, igniting the plasma, pre-washing the various sample connection lines, and verifying that samples and/or proper standards solutions are loaded into the ICP-MS system 102.

Referring still to FIG. 5A, if the controller 100 determines that the ICP-MS system 102 meets the predefined performance specification, at step 504, then the controller 100 may perform a comprehensive evaluative-check routine 506, shown as "Full Performance Check 506." In some implementations, the comprehensive evaluative-check routine 506 may include repeating the measurements performed during the preliminary evaluative-check routine 506. In some implementations, the pass criteria may be based on the standard deviation, average, or individual values of the measurements being within a pre-defined limit. In other implementations, the comprehensive evaluative-check routine 506 includes evaluations of one or more analytes not tested in the preliminary evaluative check routine 504. For example, in some implementations, the Quick Performance Check performs the evaluative check routine of Table 3 one replicate at 20 sweeps, while the Full Performance Check performs the evaluative check routine of Table 3 five replications at 120 sweeps. In some embodiments, the Full Performance Check includes a criterion in addition to those in Table 3, e.g., the Intensity Criterion BKGD5<BKGD5 threshold.

If the ICP-MS system 102 passes the comprehensive evaluative-check routine 506, the automated optimization routine 500 ends (step 510). The term "comprehensive evaluative-check routine" is interchangeably used to refer to a 'full' performance assessment. The criteria and procedures for the comprehensive evaluative-check routine may be stored on the editable configuration file along with the criteria and procedures for the preliminary evaluative-check routine.

If the instrument fails to meet one or more predefined performance specifications of either the preliminary evaluative-check routine 504 or the comprehensive evaluative-check routine 506, the controller 100 performs a Level-1 optimization routine, in some implementations.

In some embodiments, the Level-1 optimization begins, at step 508, with an optimization of the ICP torch 118. As part of the optimization, the control 100 may direct the ICP torch 118 to be adjusted relative to the ion optic assembly 128.

In some implementations, the controller 100 employs a simplex linear-programming algorithm, as part of the routine. The simplex algorithm adjusts the alignment of the ICP torch 118 using the relative standard deviation (RSD) of the measurement of an analyte, e.g., Indium ($^{115}In$). The algorithm may adjust the RSD to within 5%, which ensures that the highest three points, obtained by the simplex algorithm, are within 5% of each other.

With this method, the torch alignment routine 508 does not fail—the controller 100 selects a position (e.g., X-Y position) corresponding to the highest point among the highest three points as the optimized position (step 514).

In some implementations, if the sensitivity of the instrument is below a start-up threshold, such as 1000 cps (step 512), then the workflow would exit based on the assumption that attention is required to either the hardware or sample introduction (step 516)—for example, the torch has not initiated or the autosampler is not properly loaded in the designated tray.

Figure 6:
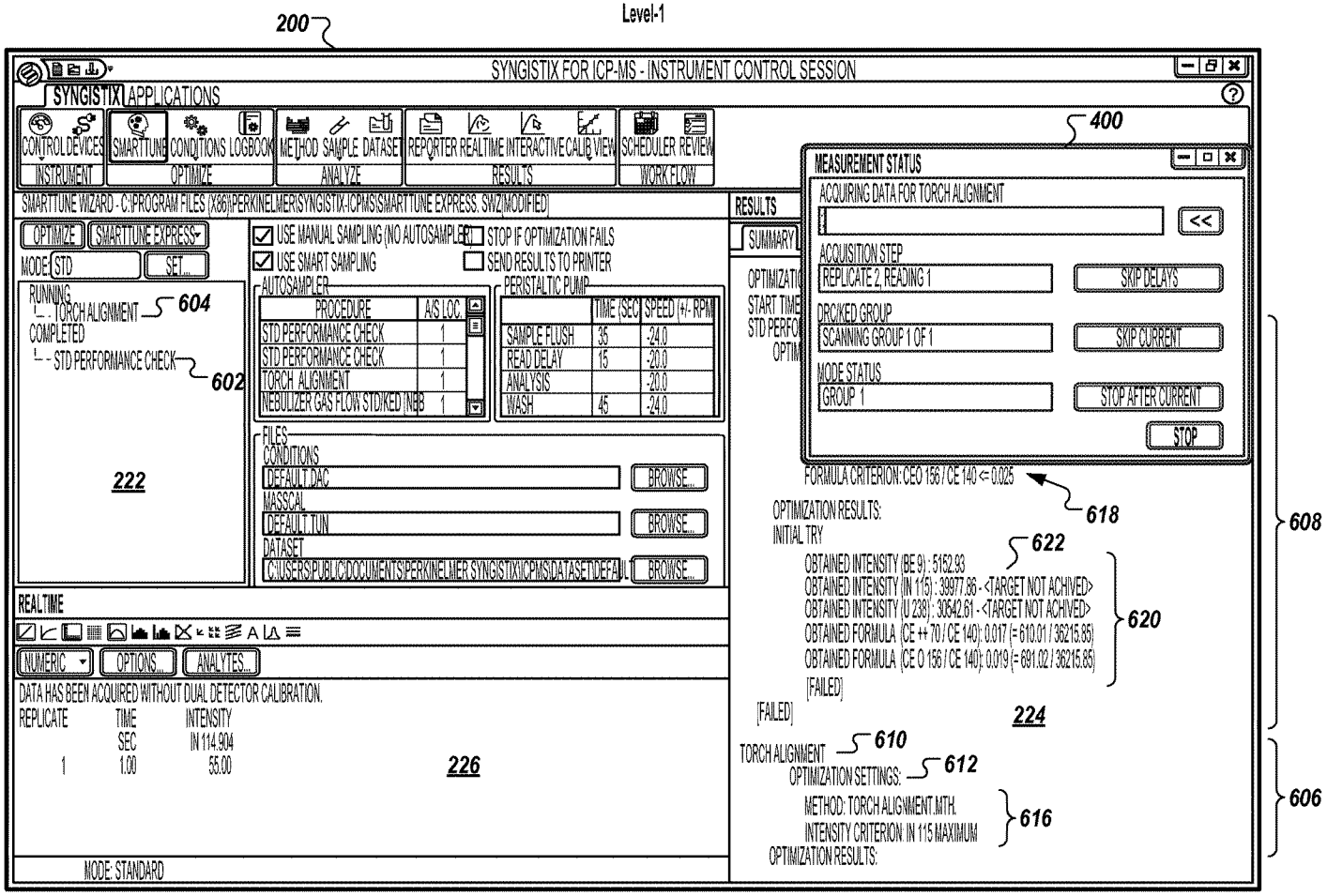
FIG. 6 illustrates an example GUI presented during the Level-1 optimization routine of FIG. 5A, according to an illustrative embodiment of the invention.

FIG. 6 illustrates an example graphical user interface (GUI) 200 presented during the automatic tuning and/optimization operation of the multi-mode ICP-MS system 102, according to an illustrative embodiment. Specifically, the interface 200 illustrates an exemplary status of the ICP-MS system 102 during the torch alignment routine 508 within the Level-1 optimization routine.

As indicated, the interface 200 includes one or more windows (e.g., 222, 224, and 226) to display the results and status of the automated optimization routine. The window 222 indicates that the torch alignment routine 508 is currently running. The window 222 also indicates subroutines that have been performed, including the preliminary and/or comprehensive evaluative-check routine 504 and 506, shown as "STD performance check 602."

Window 224 displays a log of the automated optimization routine. As shown, the window 224 displays the name 610 of the routine currently running, the settings 612 of the optimization, the method file 614, and the optimization criterion/criteria 616. Table 4 illustrates an example output of the window 224 to which the torch alignment routine 508 has been successfully performed.

TABLE 4

Example output of "Torch Alignment" optimization subroutine

| | | | |
|---|---|---|---|
| Torch Alignment | | | |
| Optimization Settings: | | | |
| Method: Torch Alignment.mth | | | |
| Intensity Criterion: In 115 Maximum | | | |
| Optimization Results: | | | |
| | Vertical | Horizontal | Intensity |
| [Passed] | −0.62 mm | −1.129 mm | 52504.51 |

As shown in Table 4, the window 224 presents the adjustment of the X-Y position (corresponding to the "vertical" and "horizontal" settings) of the ICP torch 118 (or the ion optic assembly 128), in millimeter (mm), and a measured intensity of the test analyte (e.g., Indium ($^{115}$In), shown as "In 115"). Here, the measured value is 52504.51 counts per second, which meets the criterion of the measured intensity value being higher than 1000 counts per second (cps). Window 226 displays data acquired from each sampling.

Figure 4:
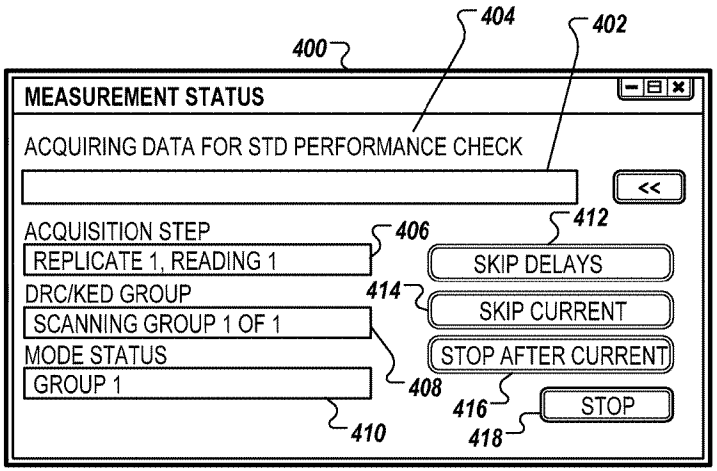
FIG. 4 illustrates an example GUI dialog box for presenting the status of automatic tuning of a multi-mode ICP-MS system, according to an illustrative embodiment of the invention.

Turning now to FIG. 4, an example progress window 400 for presenting the status of automatic tuning of a multi-mode ICP-MS system is illustrated, according to an illustrative embodiment. The dialog box 400 displays graphical and textual information relating to the status of the automated optimization routine. The dialogue box 400 may report the status 406 of the acquisition step (which may include one or more measurements), the status 408 of the scanning group, and the status 410 of the tuning mode. A progress bar 402 and a textual display 404 of the current step of the automated routine are provided.

In some implementations, the dialogue box 400 includes inputs to allow the user to interject commands during the automated optimization routine. Inputs 412, 414, 416, 418, for example, allows the user to skip a time delay, skip a current measurement, stop after the current measurement, and immediately stop the automated optimization routine (upon a failed criterion in the routine), respectively.

Turning back to FIG. 5A, the controller 100 may also optimize and/or tune the quadrupole ion deflector (QID) 134 as part of the Level-1 optimization routine following the ICP torch optimization 508.

In some implementations, the QID calibration routine 518 employs dynamic range optimization (step 518). This feature retrieves a last used voltage range for the quadrupole rods of the QID 134. To this end, the user does not have to specify a range in which the optimized setting would be used. Rather, the routine creates an operating window using these initial voltages and then expands and/or shifts the window until the optimized values are within the voltage range (step 520). The tuning step is completed when an optimized value is identified within the tested range. An example output of the QID calibration routine 518 is provided in Table 5.

TABLE 5

Example output of the quadrupole-ion-deflector (QID) optimization subroutine

| | | | | |
|---|---|---|---|---|
| QID STD/DRC | | | | |
| Optimization Settings: | | | | |
| Method: QID Calibration.mth | | | | |
| Optimization Results: | | | | |
| Initial Try | | | | |
| Start/End/Step: −17/−7/0.5 | | | | |
| Optimum Values: | | | | |
| Analyte | Mass | Points | DAC | MaxIntensity |
| Li | 7 | 21 | −14.5 | 22325.4 |
| Mg | 24 | 21 | −15 | 47406.5 |
| In | 115 | 21 | −12.5 | 52098.8 |
| Ce | 140 | 21 | −11 | 44882.4 |
| Pb | 208 | 21 | −9.5 | 22529.8 |
| U | 238 | 21 | −9 | 36350.2 |

As shown in Table 5, for example, the controller 100 may vary the voltage range from −17 to −7 in 0.5 voltage increments. The QID may be optimized using analytes, e.g., Lithium ($^{7}$Li), Magnesium ($^{24}$Mg), Indium ($^{115}$In), Cerium ($^{140}$Ce), Lead ($^{208}$Pb), and Uranium ($^{238}$U).

In some embodiments, ICP-MS system may optimize and/or tune an autolens assembly. The autolens may be coupled to a DC voltage source to maintain a selected exit potential (such as between −40V and −18V). An example of an ICP-MS with autolens is described in International Application No. PCT/US2011/026463, which is incorporated by reference herein.

Subsequent to tuning the quadrupole ion deflector (QID) 134, the controller 100 may optimize the gas flow of the nebulizer 108 in a nebulizer gas flow optimization routine 522. The routine 522 may also use dynamic range optimization (524).

In some implementations, the controller 100 creates a dynamic window around the previously known optimized nebulizer gas flow. For example, the dynamic range creates±0.2 millimeter per minute (ml/min) range. The controller 100 then adjusts the flow to find the optimized value based on the criteria (e.g., $^{156}CeO/^{140}Ce$<Threshold) for the nebulizer gas flow. If the instrument fails to meet the criteria or finds the optimized value on the ends of the dynamic range, the controller 100 shifts the window and re-optimizes.

After the Level-1 optimization (or following the nebulizer gas flow optimization routine 522), the controller 100 may perform the preliminary evaluative-check 504, shown as a "Quick Performance Check 526," to determine if the performance criteria has been met. If the criteria are met, then it will run a comprehensive evaluative-check routine 506, shown as "Full Performance Check 528," and exit the workflow if both criteria are fulfilled (step 530). If the criteria for either routines 526 and 528 have not been met, then the controller 100 initiates a Level-2 optimization (step 532).

The Level-2 optimization is a series of optimizations for the universal cell 140, including, for example, the Cell Rod Offset (CRO) and Cell Entrance and Exit. The optimization may repeat routines performed in the Level-1 optimization, after optimizing the parameters of the cell 140.

Figure 5B:
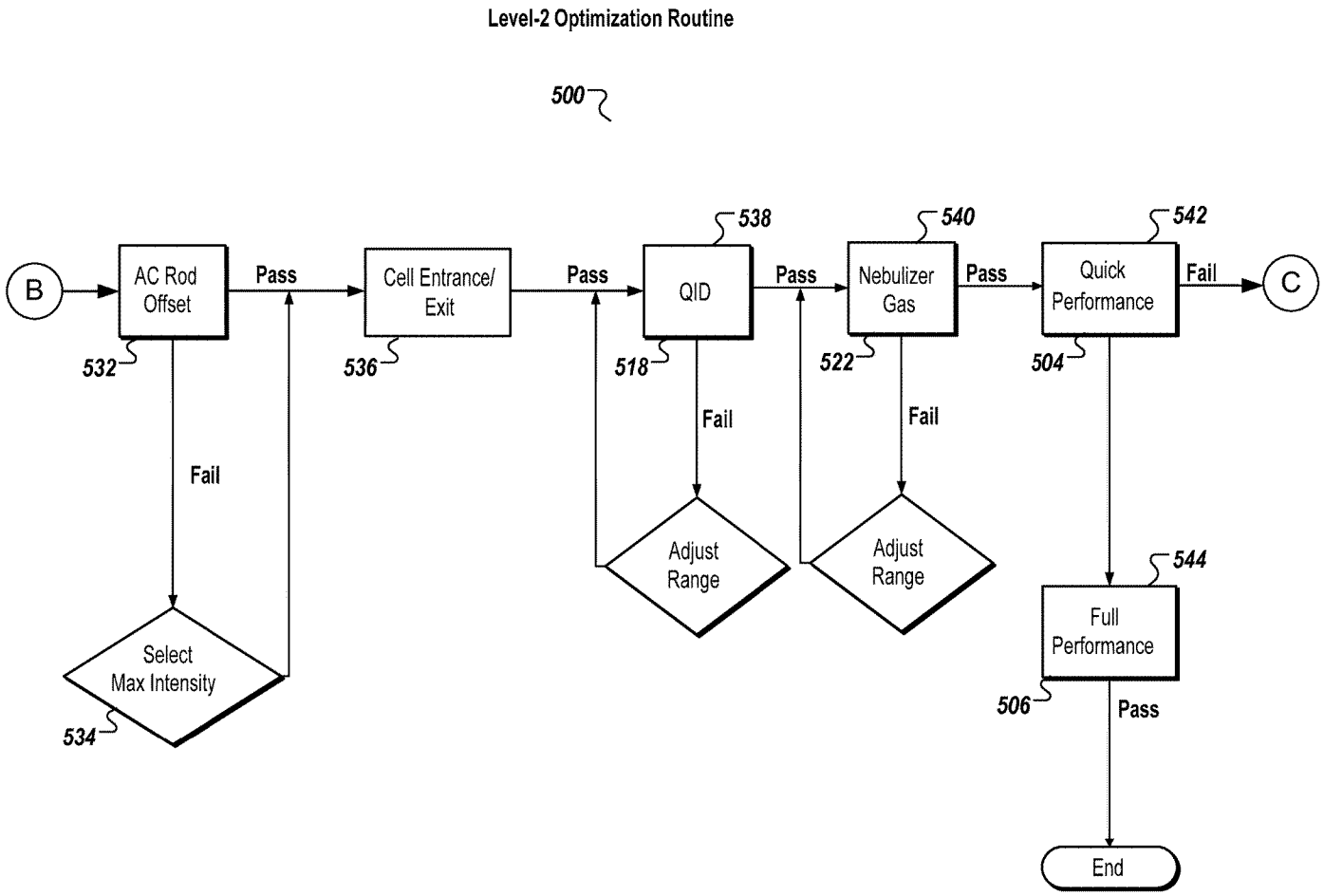
FIG. 5B is a flow chart of a Level-2 optimization routine of a method for automatic optimization of a multimode ICP-MS system (e.g., used in a vented cell (STD) mode, a reaction cell (DRC) mode, and/or a collision cell (KED) mode), according to an illustrative embodiment of the invention.

Turning to FIG. 5B, AC Rod Offset optimizations 532 (shown as "AC Rod Offset 532") are first performed in the routine. The AC Rod Offset 532 is also referred to as Cell Rod Offset (CRO) 532, in some implementations. The optimization 532 may include an optimized point determination method and relaxation of criteria operation, in which both methods allow the workflow to continue if the optimization did not meet the criteria defined. An example output of the optimization routine 532 is provided in Table 6.

TABLE 6

Example output of "AC Rod Offset" optimization subroutine

```
Cell Rod Offset STD [CRO]
  Optimization Settings:
  Method: Cell Rod Offset Voltage.mth
  Initial Try-Start/End/Step: −10/0/1
  Intensity Criterion: All Analytes Maximum
  Background Criterion: Bkgd 220 ≤ 5
  Formula Criterion: Ce++ 70/Ce 140 ≤ 0.03
  Optimization Results:
  Initial Try
  Obtained Intensities:
  Be 9: 6839.64
  In 115: 50990.84
  U 238: 36640.93
  Obtained Background (Bkgd 220) = 0.00
  Obtained Formula (Ce++ 70/Ce 140): 0.0254 (=1094.04/43112.96)
[Passed] Optimum value(s): −15
```

To find the optimized point for the AC Rod Offset and/or CRO 532, the controller 100 determines a balance point among analytes of comparatively low, medium, and high mass (e.g., $^{9}Be$, $^{115}In$, and $^{238}U$, respectively). The balance point may be determined by normalizing the intensities of each measured analytes by the respective detector voltage used in the measurement. The highest calculated value among all the normalized values is selected as a best compromised point among the measured masses and voltage setting corresponding to this point is used as the optimized setting value (step 534).

In some implementations, the controller 100 may employ a formula criteria (e.g., Ce++/Ce+) to find the optimized point. The controller 100 may also employ the background criterion to determine the best optimized point.

Figure 7:
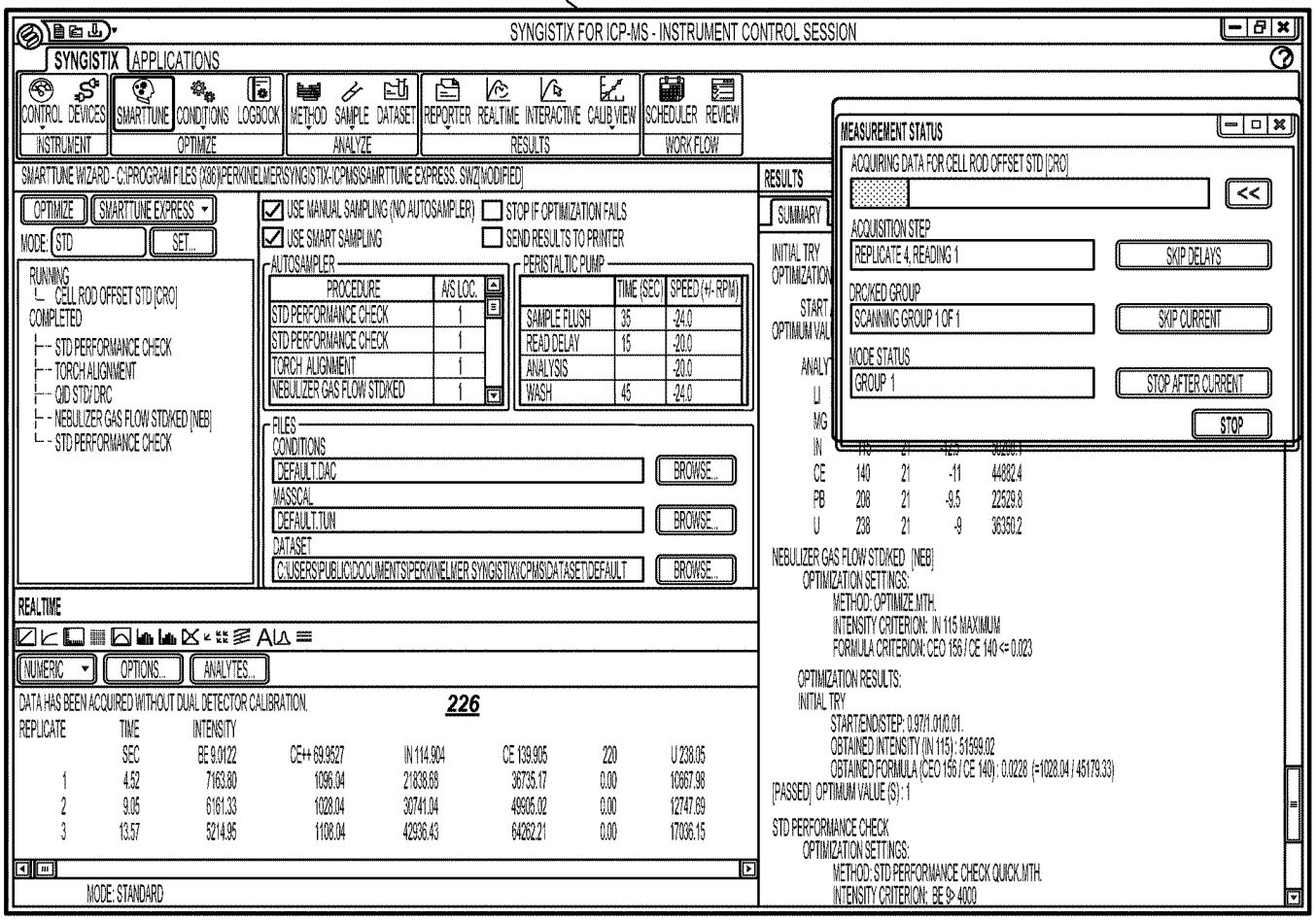
FIG. 7 illustrates an example GUI presented during the Level-2 optimization routine of FIG. 5B, according to an illustrative embodiment of the invention.

As part of the relaxation operation, the controller 100 may exclude, from the calculation, any analyte measured below a threshold (e.g., 50 cps). If more than one criterion has failed, the optimized point would only employ analytes optimization that has passed. This operation prevents the optimization routine from halting during the execution of the routine. An example GUI presented during a Level-2 optimization of the automatic tuning of a multi-mode ICP-MS system is illustrated in FIG. 7.

Referring still to FIG. 5B, the cell entrance/exit optimization 536 follows the CRO optimization 532. The cell entrance/exit may be referred to as differential pressure aperture (DPA). An example output of the cell entrance/exit optimization routine is provided in Table 7. In some implementations, the optimization 536 uses Beryllium ($^{9}Be$), Indium ($^{115}In$), Uranium ($^{238}U$) background criterion of the measured analytes. The optimized points may be determined using the relaxation of criteria operation as described in relation to the Cell Rod Offset optimization in which all, or portions, of the analytes and background criteria may be excluded.

TABLE 7

Example output of the cell entrance/exit subroutine

```
Cell Entrance/Exit Voltage (STD)
  Optimization Settings:
  Method: Cell Entrance Exit Voltage.mth
  Initial Try-Start/End/Step: −20/0/1
  Intensity Criterion: All Analytes Maximum
  Background Criterion: Bkgd 220 ≤ 5
  Optimization Results:
  Initial Try
  Obtained Intensities:
  Be 9: 7269.04
  In 115: 53915.55
  U 238: 36747.20
  Obtained Background (Bkgd 220) = 0.00
[Passed] Optimum value(s): −4
```

Once the CRO and Cell Entrance and Exit optimizations have been completed, the controller 100 may repeat one or more subroutines that have been previously-executed in the Level-1 optimization. For example, the controller 100 may re-optimize of the QID (step 538) and Nebulizer gas flow (step 540). After these optimizations 538 and 540, the controller 100 performs the preliminary and/or comprehensive evaluative check routines (steps 542 and 544). If the measurement fails the performance specification, the controller 100 proceeds to a Level-3 optimization (step 546).

Figure 5C:
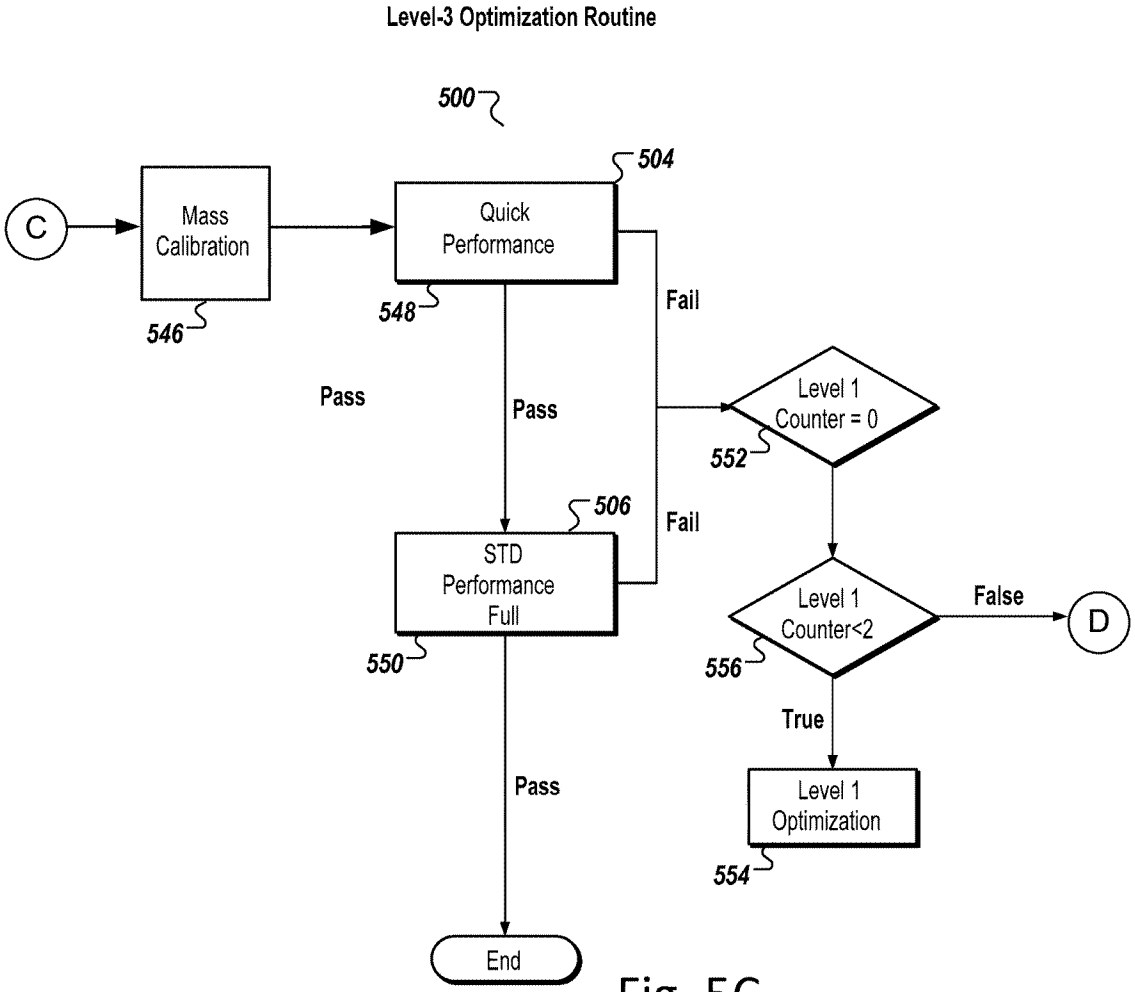
FIG. 5C is a flow chart of a Level-3 optimization routine of a method for automatic optimization of a multimode ICP-MS system (e.g., used in a vented cell (STD) mode, a reaction cell (DRC) mode, and/or a collision cell (KED) mode), according to an illustrative embodiment of the invention.

Turning now to FIG. 5C, the Level-3 optimization routine begins with mass calibration optimization (step 546). In some implementations, this optimization employs a centroid determination algorithm. An example of output of the mass calibration routine is provided in Table 8.

TABLE 8

Example output of the Mass Calibration Routine

```
Mass Calibration and Resolution
  Optimization Settings:
    Method: tuning mth
    MassCal File: Default.tun
    Iterations: 4
    Target Accuracy (+/− amu): 0.05 for MassCal. and 0.05 for Resolu-
tion
    Peak height (%) for Res. Opt.:10
  Optimization Results:
  Initial Try
    Target/Obtained mass (7.016/7.025), Target/Obtained res (0.8/0.480)
    Target/Obtained mass (23.985/23.975), Target/Obtained res (0.7/
0.713)
```

TABLE 8-continued

| Example output of the Mass Calibration Routine |
|---|
| Target/Obtained mass (114.90/114.88), Target/Obtained res (0.8/0.656) |
| Target/Obtained mass (238.05/238.075), Target/Obtained res (0.7/0.70) |
| [Passed] Optimum value(s): N/A |

It is found that the centroid determination algorithm improves the optimization speed. Typically, existing optimization techniques can take 150 seconds per attempt, in some implementations, whereas the centroid determination takes 20 seconds.

Figure 8:
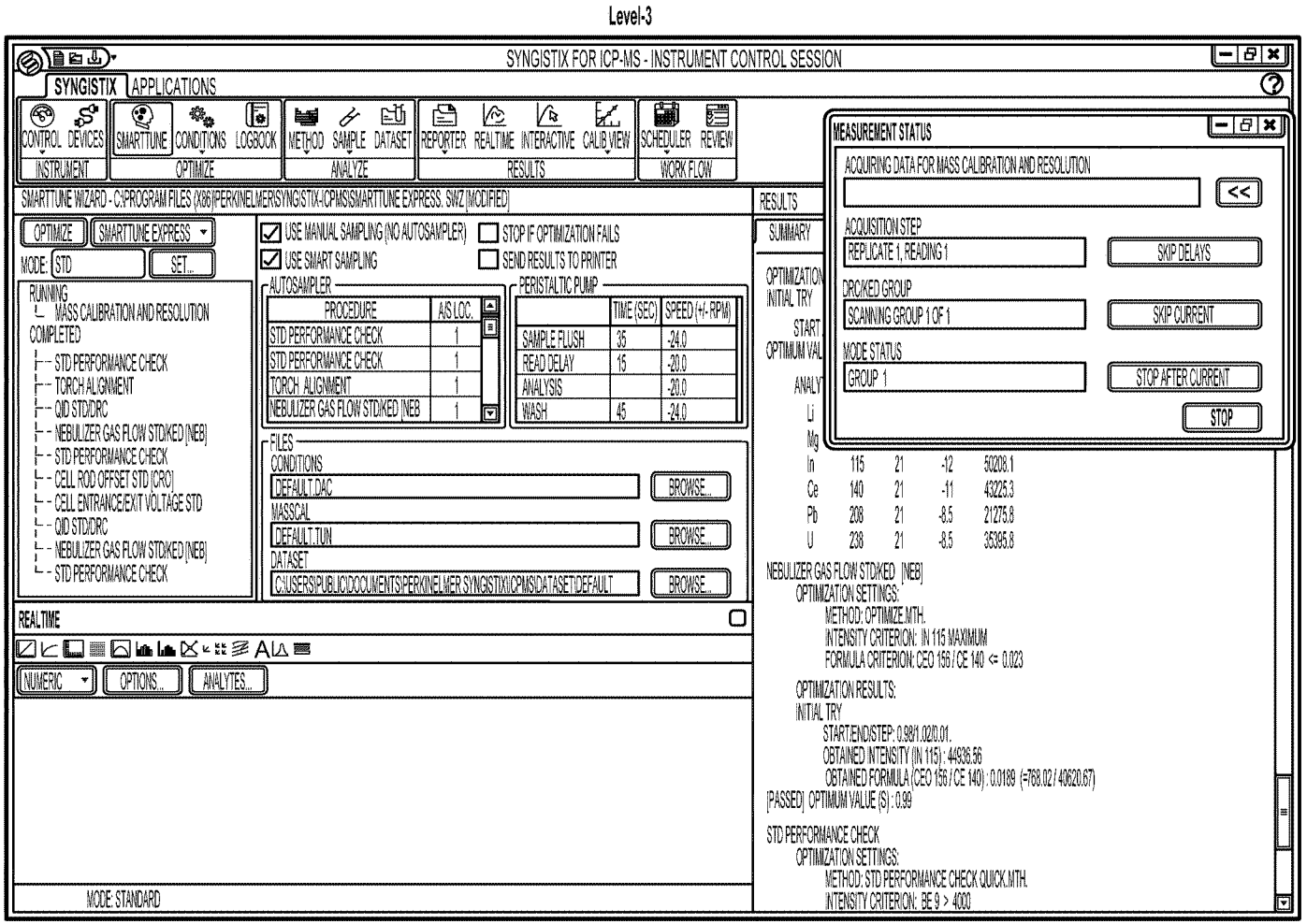
FIG. 8 illustrates an example GUI presented during the Level-3 optimization routine of FIG. 5C, according to an illustrative embodiment of the invention.

After the mass calibration, a preliminary evaluative-check routine 504, shown as "Quick Performance 548", is performed to determine whether to continue the optimization (step 552) or to perform a comprehensive evaluative-check routine 506, shown as "STD Performance Full 550." FIG. 8 illustrates an example GUI presented during the Level-3 optimization routine of FIG. 5C, according to an illustrative embodiment.

If either evaluative-check routines 548 or 550 fails, the optimization continues and the algorithm repeats the Level-1, Level-2, and Level-3 optimization routines, thereby starting the workflow from the torch alignment routine in the Level-1 optimization (step 554). The routine maintains a counter of the number of repetition and performs the routines for a predetermined number of iterations until the comprehensive evaluative-check routine 506 is passed or until the number of repetition has been performed. After the routine exceeds the number of repetition (step 556), the workflow moves to Level-4 optimization (step 558).

Figure 5D:
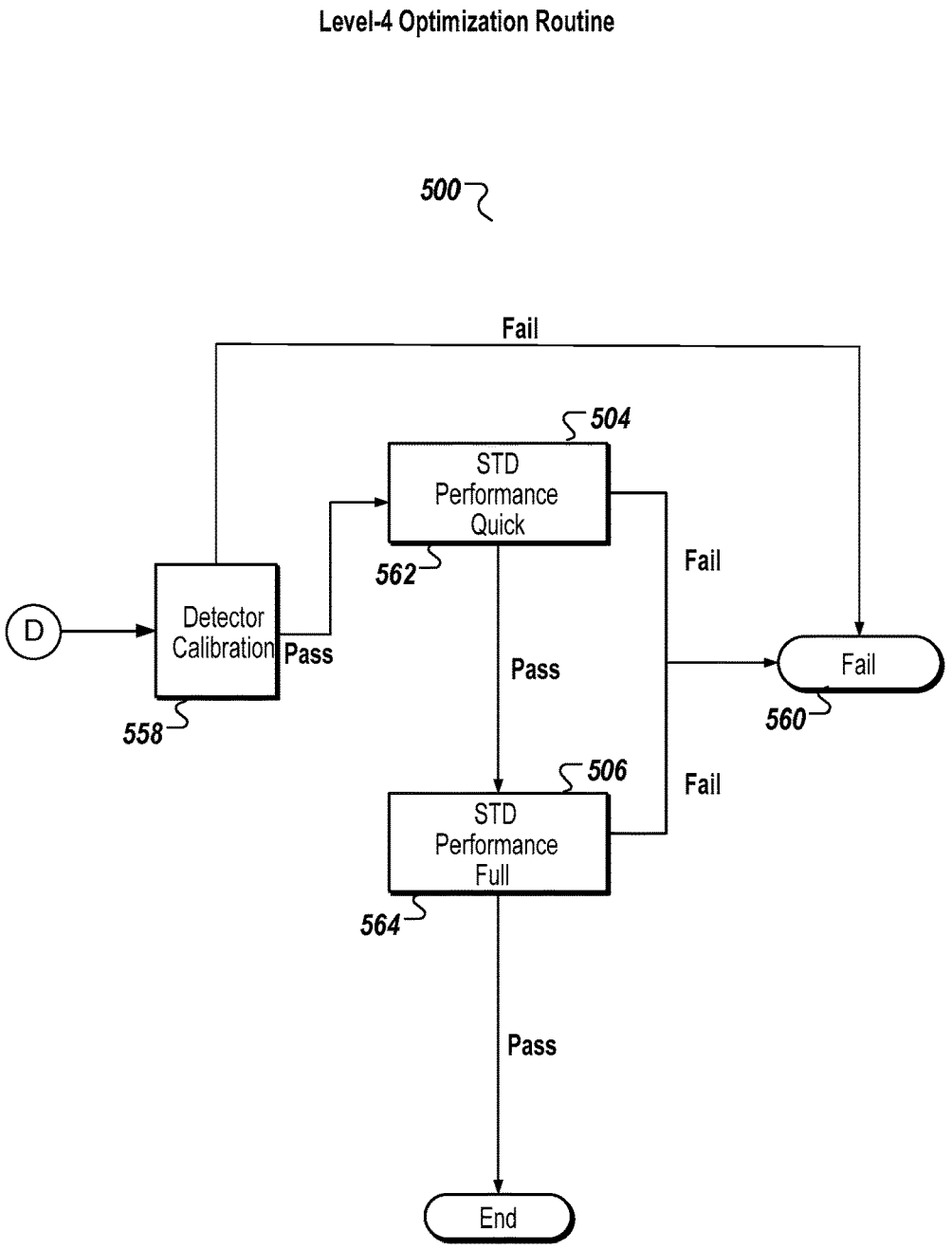
FIG. 5D is a flow chart of a Level-4 optimization routine of a method for automatic optimization of a multimode ICP-MS system (e.g., used in a vented cell (STD) mode, a reaction cell (DRC) mode, and/or a collision cell (KED) mode), according to an illustrative embodiment of the invention.

Referring now to FIG. 5D, the detector 132 is calibrated (step 558). In some implementations, the detector optimization routine 558 may be achieved by optimizing the voltages for both the pulse and analog stages to improve the detector performance. An example output of the detector optimization routine 558 is provided in Table 9.

TABLE 9

| Example output of the Detector Optimization Routine |
|---|
| Detector Voltages |
| Pulse Stage Voltage Optimization Settings: |
| Method: Pulse Stage Optimization.mth |
| Initial Try-Start/End/Step: 400/1300/80 |
| Retry 1-Start/End/Step: 600/1800/50 |
| Optimization Criterion (Pulse 76): 0.1 |
| Analog Stage Voltage Optimization Settings: |
| Method Analog Stage Optimization.mth |
| Initial Try-Start/End: −1600/1900 |
| Retry 1-Start/End: −1600-2400 |
| Optimization Criterion (Analog 80): Target Gain 10000 |

If the optimization (step 558) fails, the optimization ends (step 560). If the optimization (step 558) passes, then the controller 100 performs the preliminary evaluative check routine 504, shown as "STD Performance Quick 562". At this stage, if the performance check fails, the controller 100 will also exit the algorithm (step 560). If the performance check 562 passes, then the controller 100 will perform the comprehensive evaluative check routine 506, shown as "STD Performance Full 564."

In certain embodiments, the controller 100 is configured to optimize and/or tune a multi-mode ICP-MS system 102 operating in reaction cell mode (e.g., DRC). Optimization of the reaction cell mode is now discussed.

Optimization of the reaction cell mode is performed subsequent to the automated optimization routine 500, as described in relation to FIGS. 5A-5D. Optimization of standard mode drives the sensitivity for the secondary modes of KED and DRC. To this end, the controller 100 executes the automated optimization routine 500, then the reaction cell optimization routine 1000 (shown in FIG. 10). In certain embodiments, if other modes were selected during setup, then the algorithm completes and/or exits the STD mode workflow and enters the next mode of operation based on the following sequence: STD, DRC, and then KED.

Figure 9:
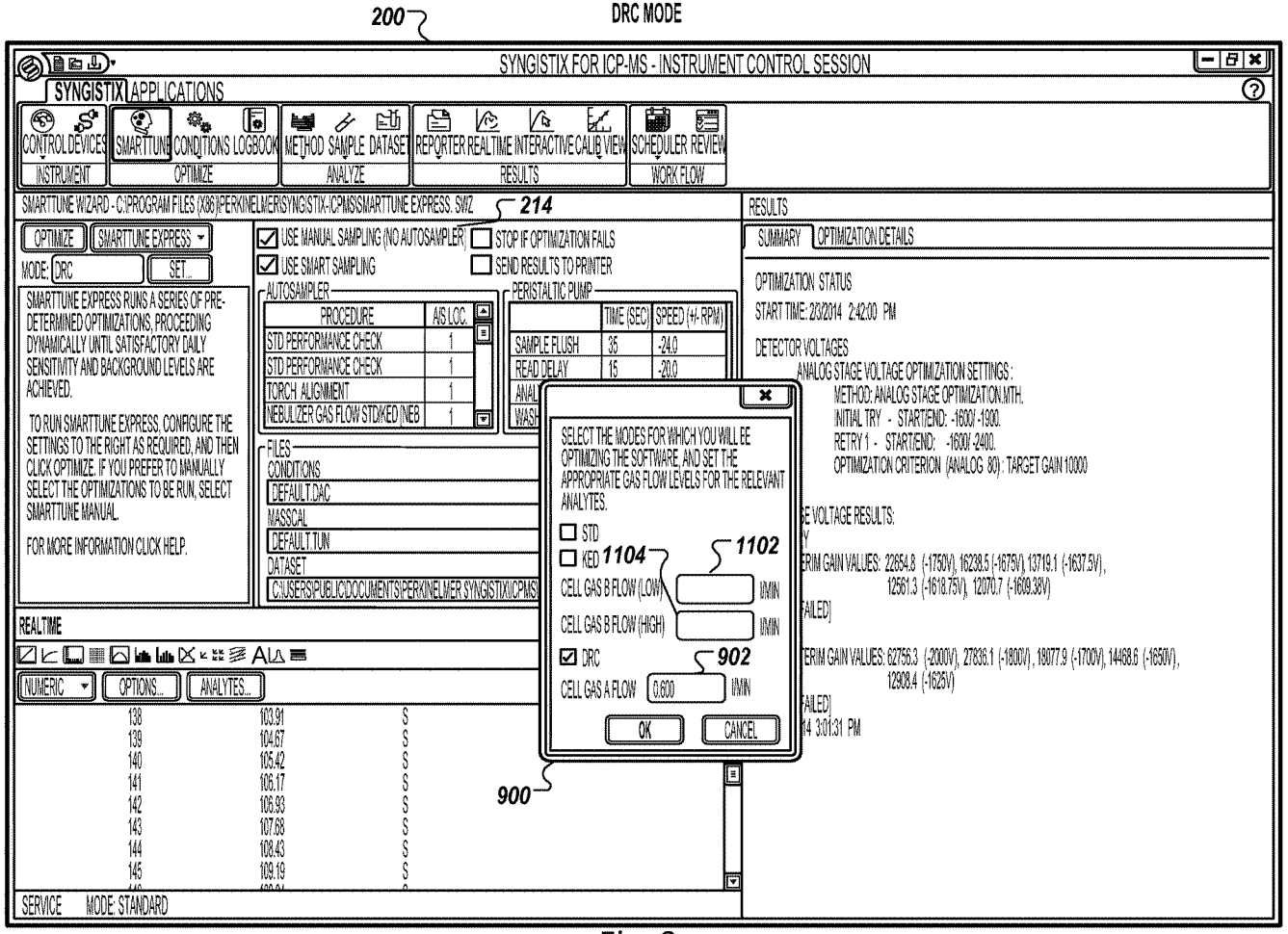
FIG. 9 illustrates an example GUI for setting the operational mode of a multimode ICP-MS system, according to an illustrative embodiment of the invention.

Turning back to FIG. 2, the interface 202 includes an input 206 to allow the user to select an automated optimization routine for a given operational mode of the ICP-MS system 102 (for example, vented cell mode, reaction cell mode, and collision cell mode. Upon a selection of the reaction cell mode (shown as the DRC mode), the interface 202 prompts the user for operational configuration of the reaction cell mode. The configuration may include a flow rate of the reactive gas for the reaction cell (e.g., the cell 140). FIG. 9 illustrates an example GUI 200 to receive such an input 902.

Figure 10:
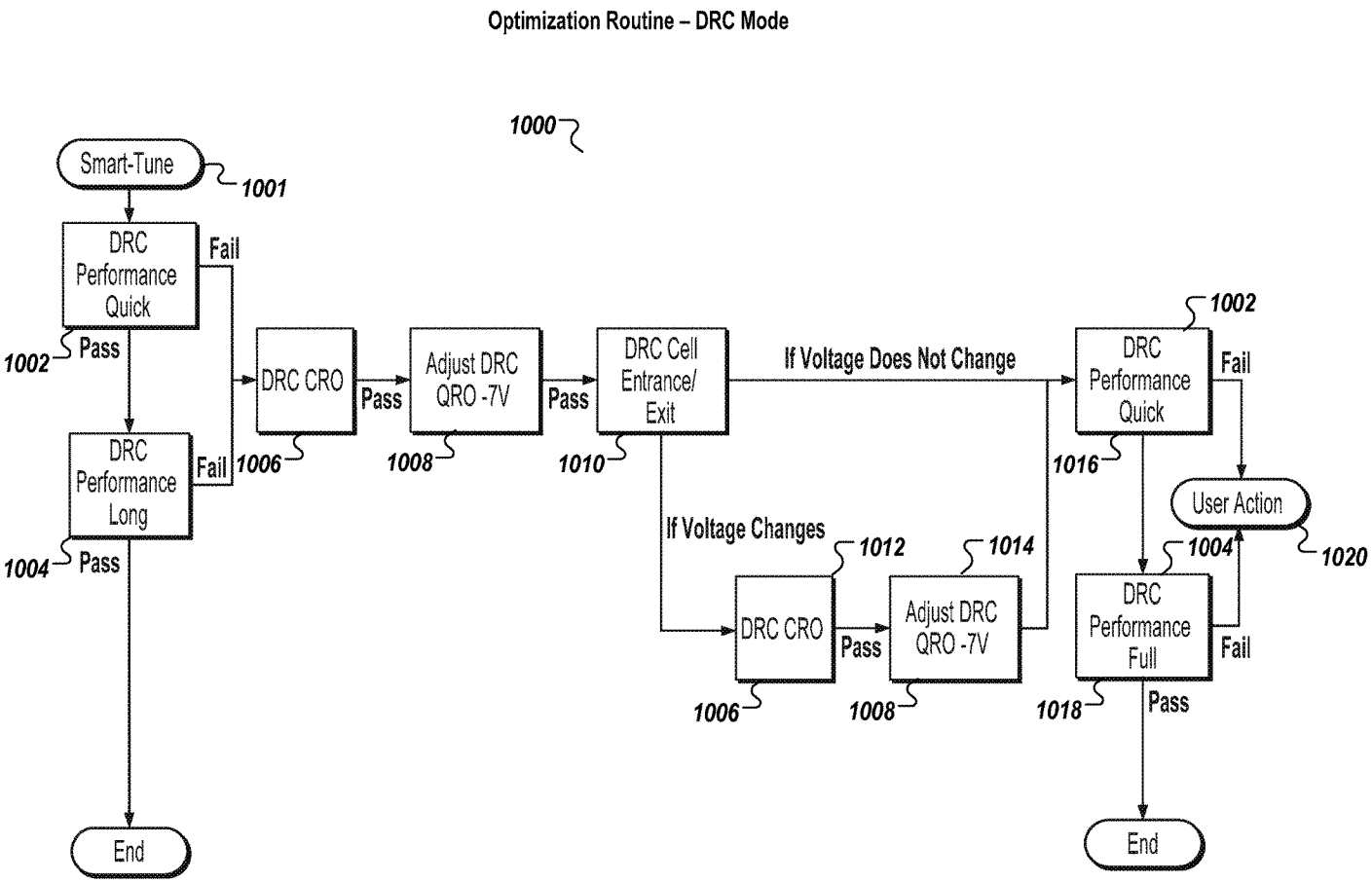
FIG. 10 is a flow chart of a method for automatic optimization of a multi-mode ICP-MS system in reaction cell mode (e.g., DRC), according to an illustrative embodiment of the invention.

Turning now to FIG. 10, a flow chart of a method 1000 for automatic tuning of a multi-mode ICP-MS system in reaction cell mode is illustrated, according to an illustrative embodiment.

Similar to the vented cell (e.g., STD) mode, when the optimization begins (step 502), the controller 100 performs a preliminary evaluative check routine, shown as "DRC Performance Quick 1002." Example(s) criterion/criteria of the preliminary evaluative check routine 1002 for the reaction cell mode (e.g., DRC) is provided in Table 10. The routine 1002 may use iron ($^{56}$Fe) as the test analyte.

TABLE 10

| Example criteria of a preliminary evaluative routine for the reaction cell mode (e.g., DRC) |
|---|
| Intensity Criterion: $^{56}Fe > {}^{56}Fe_{threshold}$ |

If the routine passes, the controller 100 performs the comprehensive evaluative check routine for the DRC mode, shown as "DRC Performance Long 1004." The evaluative-check routines 1004 and 1006 are performed at the user specified flow rate 902. In one embodiment, the Quick Performance Check performs the evaluative check routine of Table 9 one replicate (once) at 20 sweeps, while the Full Performance Check performs the evaluative check routine of Table 9 five replicates at 60 sweeps. Other predetermined numbers of replicates and/or sweeps may be prescribed.

As shown in FIG. 10, if the instrument fails either evaluative-check routine 1004 or 1006, the CRO of the reaction cell is optimized (step 1006). The optimization 1006 may include varying the voltages or energy level supplied to the rods within the cell 140. The routine 1006 may select the maximum measured signal for the analyte, e.g., Iron ($^{56}$Fe). Once the voltages for the CRO have been determined, the routine establishes the DRC Quadrupole Rod Offset ("DRC QRO") as a voltage offset (e.g., ±7 volts) from the DRC CRO (step 1008). That is, the upper and lower voltages of the QRO is made positive and negative by the offset (e.g., +7V and −7V) from the central offset of the cell rod voltages.

As shown in the figure, following the DRC CRO optimization, the controller 100 performs the DRC Cell Entrance/Exit voltage optimization (step 1010). In some implementations, the optimization 1010 performs (i) a first order derivative algorithm to calculate the maximum drop in sensitivity and then (ii) adjusts the voltage by an offset voltage (e.g., −2 volts). The offset ensures the correct optimization is selected.

In some implementations, if the controller 100 determines that the voltage cell entrance and voltage has changed, the controller 100 repeats the cell rod offset and quadrupole cell offset routines 1006, 1008, shown as steps 1012, and 1014. Subsequently, the controller 100 performs the evaluative-check routines 1002 and 1004, shown as "DRC Performance Quick 1016" and "DRC Performance Full 1018." If either of the evaluative-check routines 1016 or 1018 fails, then the optimization of the reaction cell mode also fails.

In certain embodiments, the controller 100 is configured to optimize and/or tune a multi-mode ICP-MS system 102 operating in collision cell mode (e.g., KED). Optimization of the collision cell mode is now discussed.

As discussed above, optimization of the standard mode drives the sensitivity for the secondary modes of KED. To this end, the controller 100 may execute the automated optimization routine 500, then the collision cell optimization routine 1200 (shown in FIG. 12).

Figure 11:
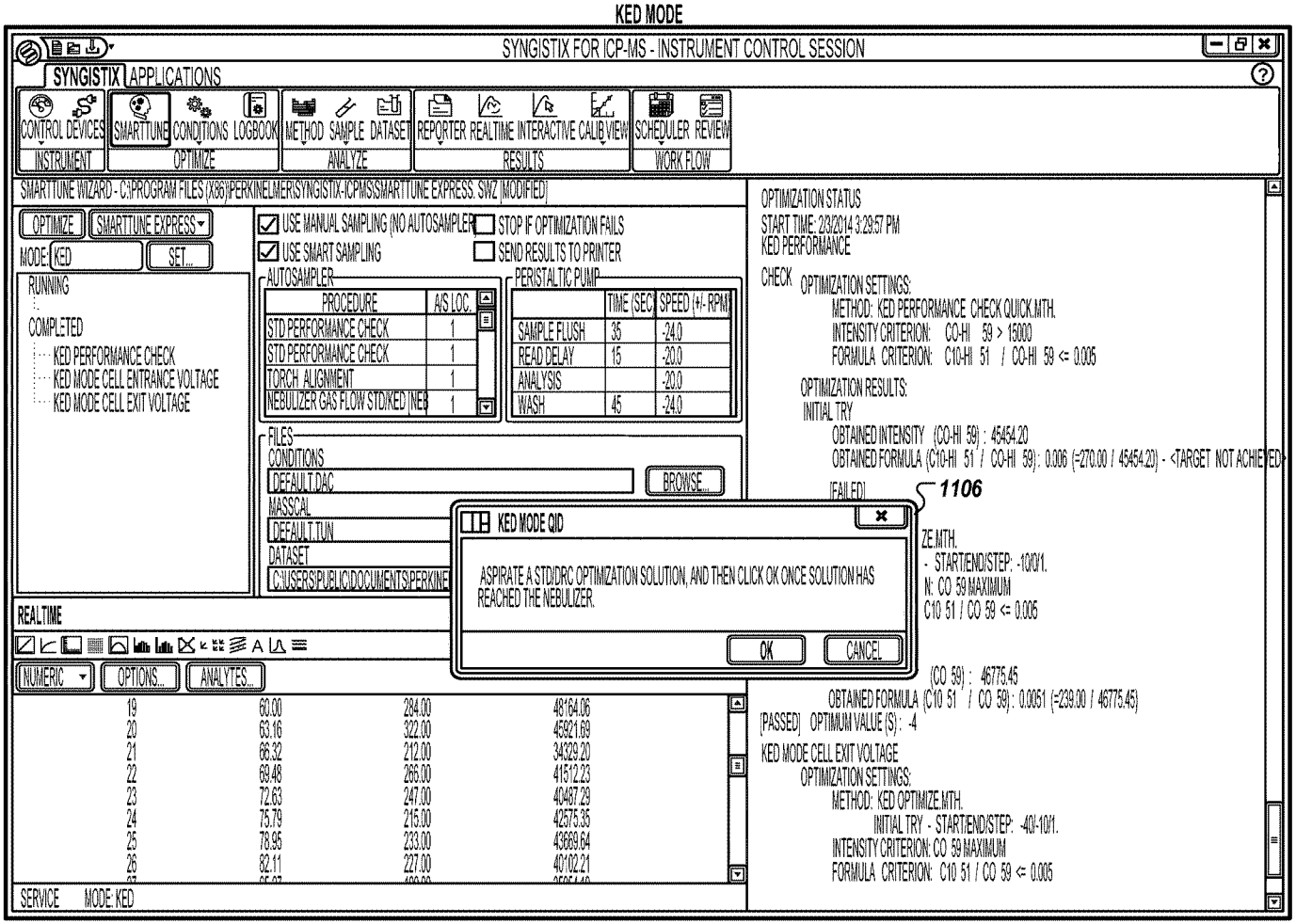
FIG. 11 illustrates an example GUI configured for automatic tuning of a multi-mode ICP-MS system in collision cell mode (e.g., KED), according to an illustrative embodiment of the invention.

Turning back to FIG. 2, the interface 202 includes an input 206 to allow the user to select a tuning and/or optimization routine for a given operational mode (e.g., vented cell mode, reaction cell mode, and collision cell mode) of the ICP-MS system 102. Upon a selection of the collision cell mode (shown as the KED mode), the interface 202 prompts the user for operational configuration of the collision cell mode. The configuration may include a flow rate range of the gas for the collision cell (e.g., the cell 140), including a low flow rate and a high flow rate. FIG. 9 illustrates an example GUI 200 to receive such inputs 1102 and 1104. If manual sampling is selected, the GUI 200 may prompt the user to aspirate the sampled solution. FIG. 11 illustrates an example 1106 of such a prompt.

Figure 12:
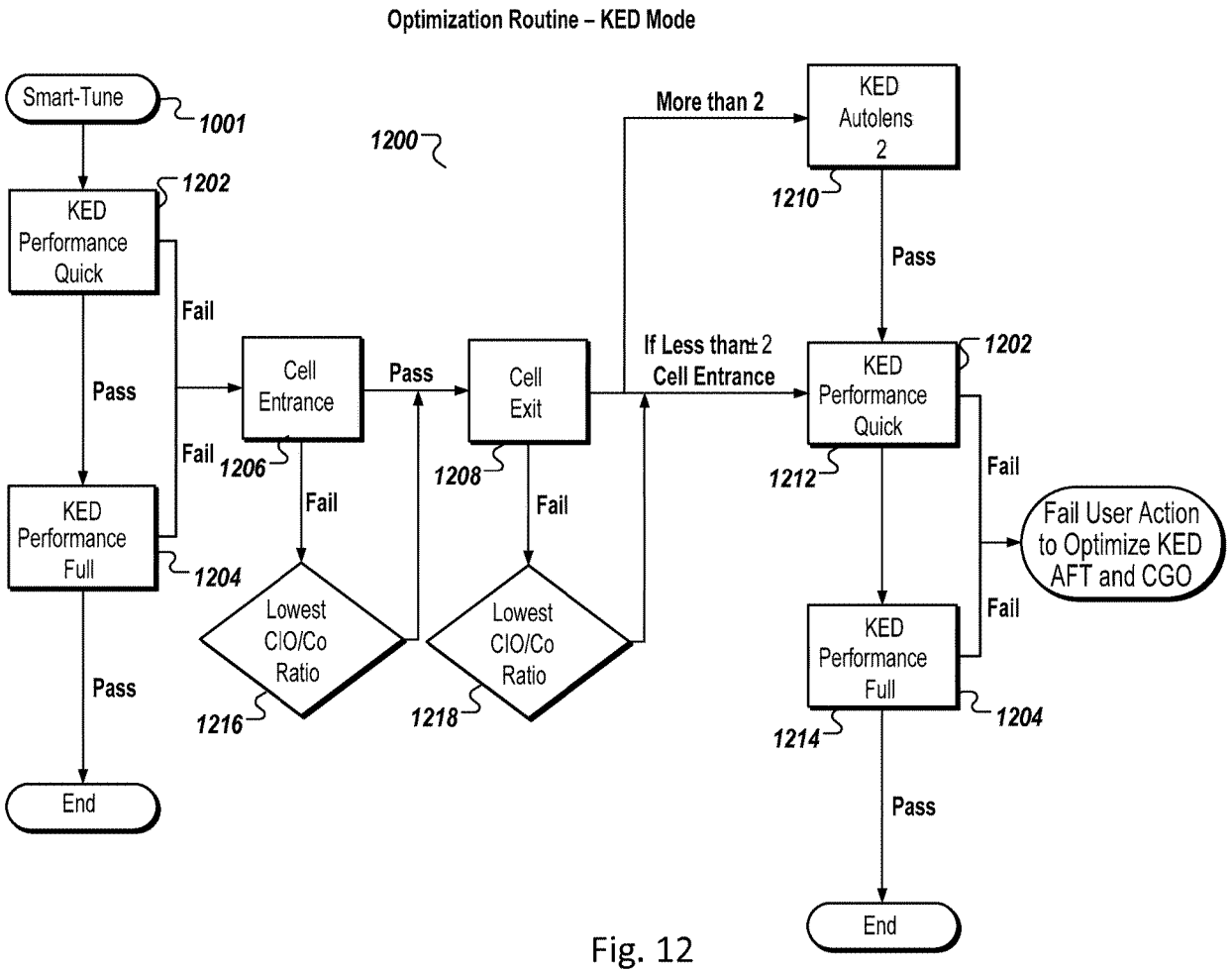
FIG. 12 is a flow chart of a method for automatic tuning of a multi-mode ICP-MS system in collision cell mode, according to another illustrative embodiment of the invention.

Turning now to FIG. 12, a flow chart of a method for automatic optimization of a multi-mode ICP-MS system in collision cell (e.g., KED) mode is illustrated, according to an illustrative embodiment. Upon receiving a command, for example, via the widget 204, to initiate the automated optimization operation in the collision cell mode, the controller 100 may execute the automated optimization routine 500, as described in relation to FIGS. 5A-5D. Subsequent to the executing the automated optimization routine 500, shown as "smart-tune 1001," the controller 100 may then execute the collision cell optimization routine 1200.

In some implementations, the KED optimization is based on the maximizing of a given analyte, e.g., Cobalt ($^{59}$Co) while maintaining an analyte ratio (e.g., $^{51}$ClO/$^{59}$Co) ratio of less than a predefined threshold (e.g., 0.5%) when operating the gas at a high gas flow to the cell 140 (steps 1206 and 1208). The optimization may employ a relaxation operation of the criteria to allow the automated workflow to continue even though the ratio is determined to be above the threshold (e.g., 0.5%) (steps 1216 and 1218).

Still looking at FIG. 12, the controller 100 initially performs a preliminary evaluative check routine for the KED mode, shown as "KED Performance Quick 1202," followed by a comprehensive evaluative check routine, shown as "KED Performance Full 1204." The preliminary routine may be based on the high gas flow ratio of an analyte ratio, e.g., $^{51}$ClO/$^{59}$Co. Examples of the criteria of the preliminary evaluative check routine is provided in Table 11. The comprehensive routine may use both the low and high gas flow specifications to determine pass or failure as well as additional analytes and analyte ratios, e.g., $^{59}$Co at high flow, $^{78}$Ar2 at high flow, $^{51}$ClO at high flow, $^{156}$CeO/$^{140}$Ce at high flow, and $^{51}$ClO/$^{59}$CO at low flow. Examples of the criteria of the comprehensive check routine is provided in Table 12.

TABLE 11

Example criteria of a preliminary evaluative routine for the collision cell mode (e.g., KED)

| | |
|---|---|
| Intensity Criterion: | $^{59}\mathrm{Co} > {}^{59}\mathrm{CO}_{threshold}$ |
| Formula Criterion: | $^{51}\mathrm{ClO}_{hi_flow}/{}^{59}\mathrm{CO}_{hi_flow} \leq$ Ratio_threshold |

TABLE 12

Example criteria of a comprehensive evaluative routine for the collision cell mode (e.g., KED)

| |
|---|
| KED Performance Check |
| Optimization Settings |
| Method: KED Performance Check Quick.mth |
| Intensity Criterion: $^{59}\mathrm{Co}_{hi_flow} > 15000$ |
| Intensity Criterion: $^{78}\mathrm{Ar2}_{hi_flow} \leq 30$ |
| Formula Criterion: $^{51}\mathrm{ClO}_{hi_flow}/{}^{59}\mathrm{CO}_{hi_flow} \leq 0.005$ |
| Formula Criterion: $^{156}\mathrm{CeO}_{hi_flow}/{}^{140}\mathrm{Ce}_{hi_flow} \leq 0.01$ |
| Formula Criterion: $^{51}\mathrm{ClO}_{low_flow}/{}^{59}\mathrm{CO}_{low_flow} \leq 0.02$ |

If the evaluative routines 1202 and/or 1204 are not passed, the controller 100 performs the KED Cell entrance voltage optimization (step 1206). The KED optimization 1206 may performs similar optimization and relaxation operations as described in relation to FIG. 10. Following the KED Cell Entrance optimization (step 1206), the controller 100 performs the KED Cell Exit voltage optimization routine 1208, shown as "Cell Exit 1208." The routine may also employ the relaxation criteria (step 1218). If there is a change in the cell entrance by greater than ±2 volts, the KED QID calibration routine is performed (step 1210).

Subsequently, the controller 100 re-performs the evaluative-check routines 1202 and 1204, shown as "KED Performance Quick 1212" and "KED Performance Full 1214." If either of the evaluative-check routines 1212 or 1214 fails, then the optimization of the collision cell mode also fails.

Figure 13:
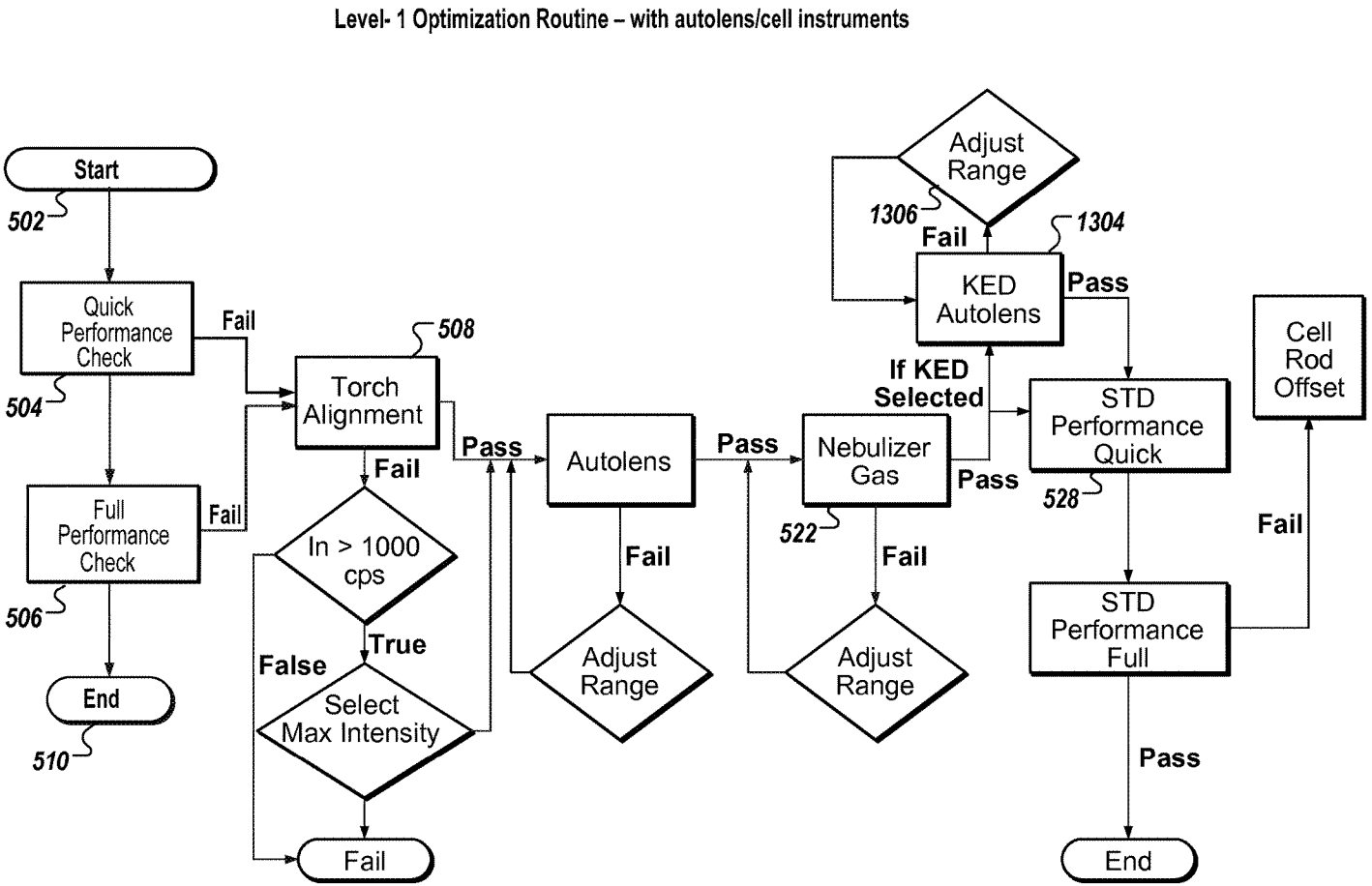
FIG. 13 is a flow chart of a method for automatic optimization of another type of multi-mode ICP-MS system, according to an illustrative embodiment of the invention.

Turning now to FIG. 13, a flow chart of a method for automatic optimization of a multimode ICP-MS system with cell instrument is illustrated, according to an alternate embodiment. In this embodiment, rather than a QID, the ICP-MS is equipped with autolens.

When performing the Level-1 optimization, as described in relation to FIG. 5A, the controller 100 may perform an autolens check (step 1304). If it fails, a range adjustment is performed (step 1306). If it passes, the controller 100 performs a performance check quick (step 528) and the Level-2 optimization continues.

Figure 14:
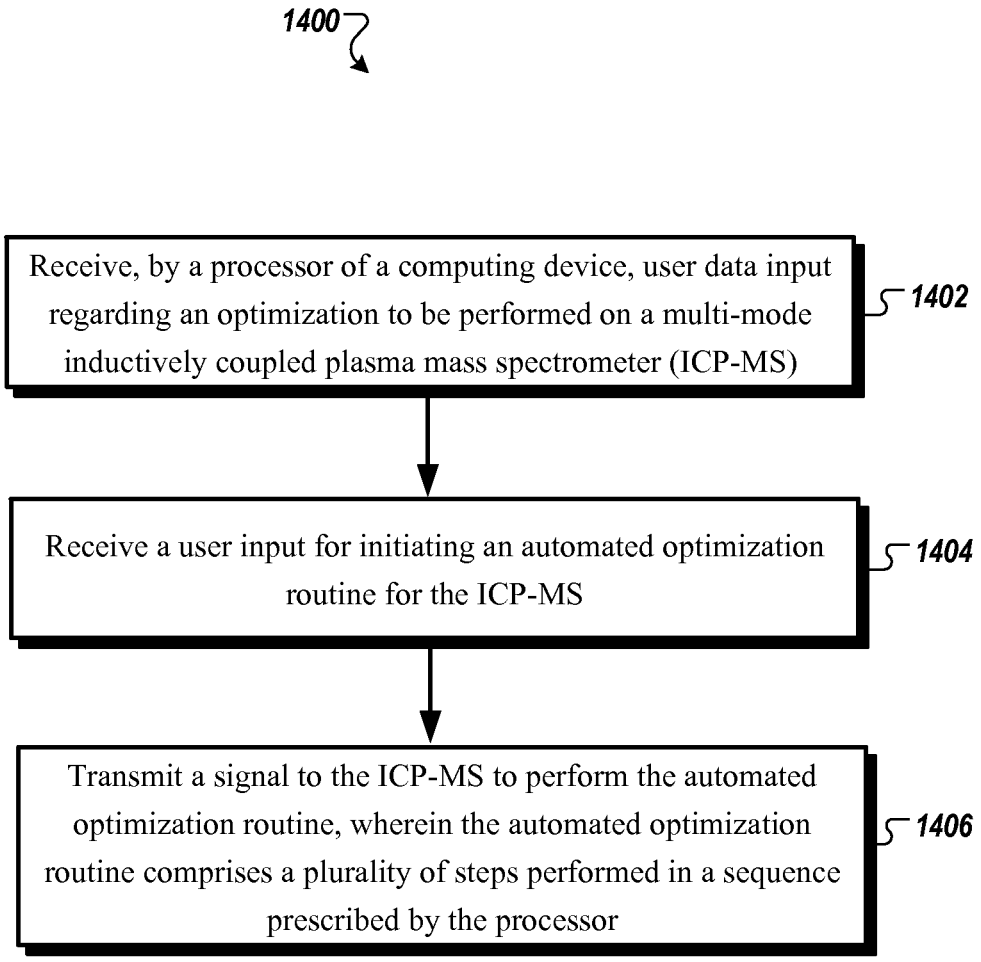
FIG. 14 illustrates a flow chart of an example method for tuning a multi-mode ICP-MS system, according to an embodiment of the invention.

FIG. 14 illustrates a flow chart of an example method 1400 for tuning a multi-mode ICP-MS system 102, according to an embodiment. The method 1400 includes receiving, by a processor of a computing device, user data input regarding an optimization to be performed on a multi-mode ICP-MS system 102 where the user data input includes an identification of one or more selected modes of operation in which the ICP-MS 102 is to be operated (step 1402). In some implementations, the one or more modes includes one, two, or all three of: (a) vented cell mode, (b) reaction cell mode, e.g., dynamic reaction cell "DRC" mode, and (c) collision cell mode, e.g., kinetic energy discrimination "KED" mode.

The method includes receiving, by the processor, a user input 204 for initiating an automated optimization routine 500 for the ICP-MS 102. In some implementations, the user input 204 for initiating the routine includes a 'single click', a keystroke, a swipe, selection of a graphical user interface widget, or any other user input, delivered via a user interface device, e.g., a keyboard, a mouse, or any other UI device (step 1404).

The method includes, following receipt of the user input 204 for initiating the routine, transmitting, by the processor, a signal to the ICP-MS 102 to perform the automated optimization routine (e.g., routines 500, 1000, 1200) where the automated optimization routine 500 includes steps performed in a sequence prescribed by the processor (1406). The automated optimization routine may (i) adjust/align the ICP torch 116 relative to the mass spectrometer, (ii) calibrate the QID 134 and optimize the quadrupole rod offset (QRO) thereof, (iii) optimize the gas flow of the nebulizer 108, (iv) optimize the cell rod offset (CRO) and entrance and/or exit offset of the cell 140, (v) calibrate the mass filter 142, and (vi) optimize the detector 132, as described in the flow chart in relation to FIGS. 5A-5D.

When performing the automated optimization routine 500, the automated optimization routine 500 may include an ICP-MS performance assessment subsequence 504 and/or 506. The subsequence includes the steps of automatically conducting a first performance assessment 504 (e.g., 'quick' assessment), then, if the first assessment is satisfactory, conducting a second performance assessment 506 (e.g., 'full' assessment). Else, if the first assessment 504 is unsatisfactory, the subsequence ends and identifies the performance assessment as failed. The first performance assessment 504 contains fewer steps and is less time consuming to conduct than the second performance assessment 506. In certain embodiments, the automated optimization routine 500 includes a plurality of levels. Each level has steps associated therewith where the routine is programmed to proceed from a given level to a subsequent level if a performance assessment subsequence performed at the conclusion of the preceding steps in the given level is identified as failed Else, if the performance assessment subsequence performed at the conclusion of the preceding steps in the given level is identified as satisfactory, the routine is programmed to end the optimization.

In certain embodiments, the controller 100 provides the user with flexibility in customizing the optimization of the ICP-MS. Referring back to FIG. 2, the interface 200 may include inputs to allow the user to customize the automated optimization routine.

As shown in the figure, the auxiliary panel 209 includes an input 212 to allow users to specify the autosampler locations (shown as "A/S loc." 212), namely the tray position having a solution for each subroutine.

The auxiliary panel 209 includes an input 216 to detect and determine when two sequential functions use the same solution when operating in manual sampling mode. When such sequential functions are detected, the controller 100 may skip, or not require, the aspiration of the sample.

The auxiliary panel 209 includes an interface 218 to allow the user to configure or view the operating parameters of the peristaltic pump 106, for example, the sample-flush time (e.g., in seconds), the sample-flush speed (i.e., pump speed in RPM), the read-delay time (e.g., in seconds), the read-delay speed (e.g., in RPM), the analysis speed (e.g., in RPM), the wash time (e.g., in seconds), and the wash speed (e.g., in RPM). The sample-flush time specifies the beginning of the acquisition period. The sample-flush speed specifies the operational speed of the pump. The read-delay time specifies between the end of the flush cycle and the beginning of the data acquisition. The read-delay speed specifies the pump rate during the read delay cycle. The analysis speed displays the pump rate during the determination of the analysis. The wash time specifies the rinsed time following the completion of each data acquisition. The wash speed specifies the pump speed during the wash cycle.

The auxiliary panel 209 includes an input 220 to allow the user to immediately stop the ICP-MS following any unsuccessful optimization operation.

Figure 15:
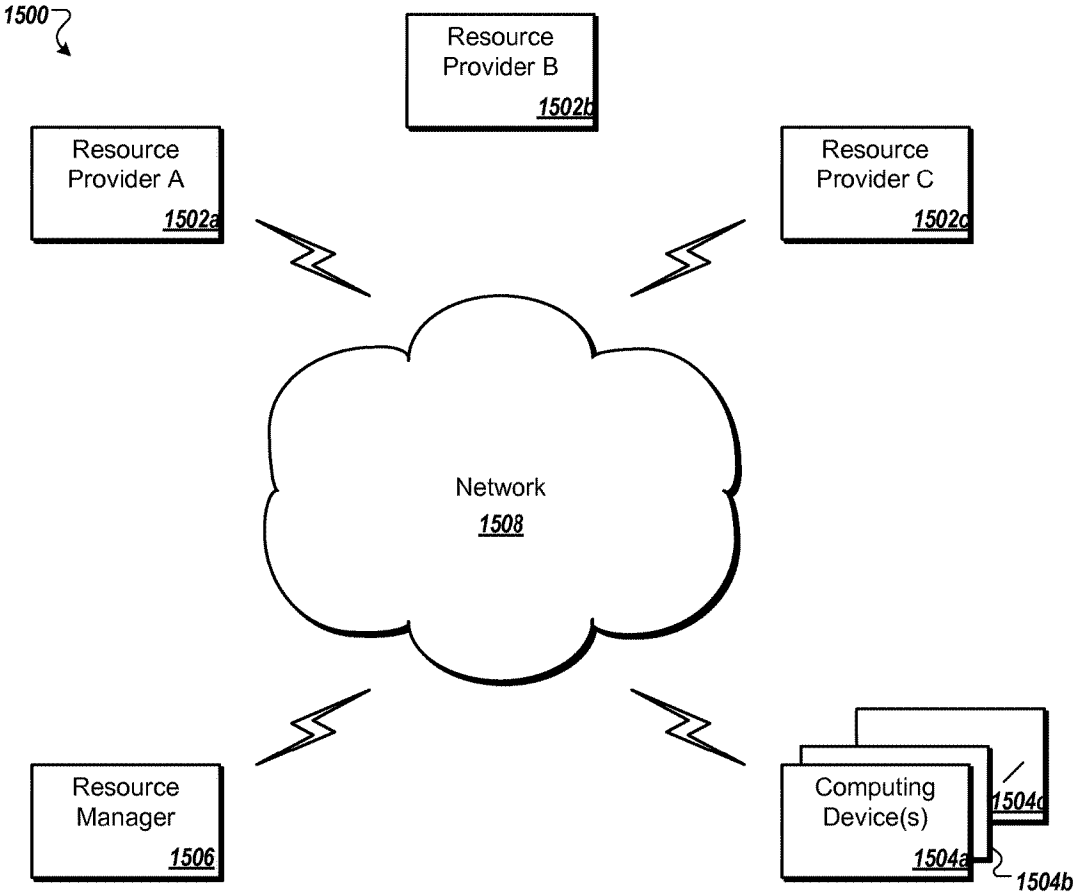
FIG. 15 is a block diagram of an example network environment for use in the methods and systems for automated optimization of a multi-mode ICP-MS system, according to an illustrative embodiment.

In brief overview, referring now to FIG. 15, a block diagram of an exemplary cloud computing environment 1500 is shown and described. The cloud computing environment 1500 may include one or more resource providers 1502*a*, 1502*b*, 1502*c* (collectively, 1502). Each resource provider 1502 may include computing resources. In some implementations, computing resources may include any hardware and/or software used to process data. For example, computing resources may include hardware and/or software capable of executing algorithms, computer programs, and/or computer applications. In some implementations, exemplary computing resources may include application servers and/or databases with storage and retrieval capabilities. Each resource provider 1502 may be connected to any other resource provider 1502 in the cloud computing environment 1500. In some implementations, the resource providers 1502 may be connected over a computer network 1508. Each resource provider 1502 may be connected to one or more computing devices 1504*a*, 1504*b*, 1504*c* (collectively, 1504), over the computer network 1508.

The cloud computing environment 1500 may include a resource manager 1506. The resource manager 1506 may be connected to the resource providers 1502 and the computing devices 1504 over the computer network 1508. In some implementations, the resource manager 1506 may facilitate the provision of computing resources by one or more resource providers 1502 to one or more computing devices 1504. The resource manager 1506 may receive a request for a computing resource from a particular computing device 1504. The resource manager 1506 may identify one or more resource providers 1502 capable of providing the computing resource requested by the computing device 1504. The resource manager 1506 may select a resource provider 1502 to provide the computing resource. The resource manager 1506 may facilitate a connection between the resource provider 1502 and a particular computing device 1504. In some implementations, the resource manager 1506 may establish a connection between a particular resource provider 1502 and a particular computing device 1504. In some implementations, the resource manager 1506 may redirect a particular computing device 1504 to a particular resource provider 1502 with the requested computing resource.

Figure 16:
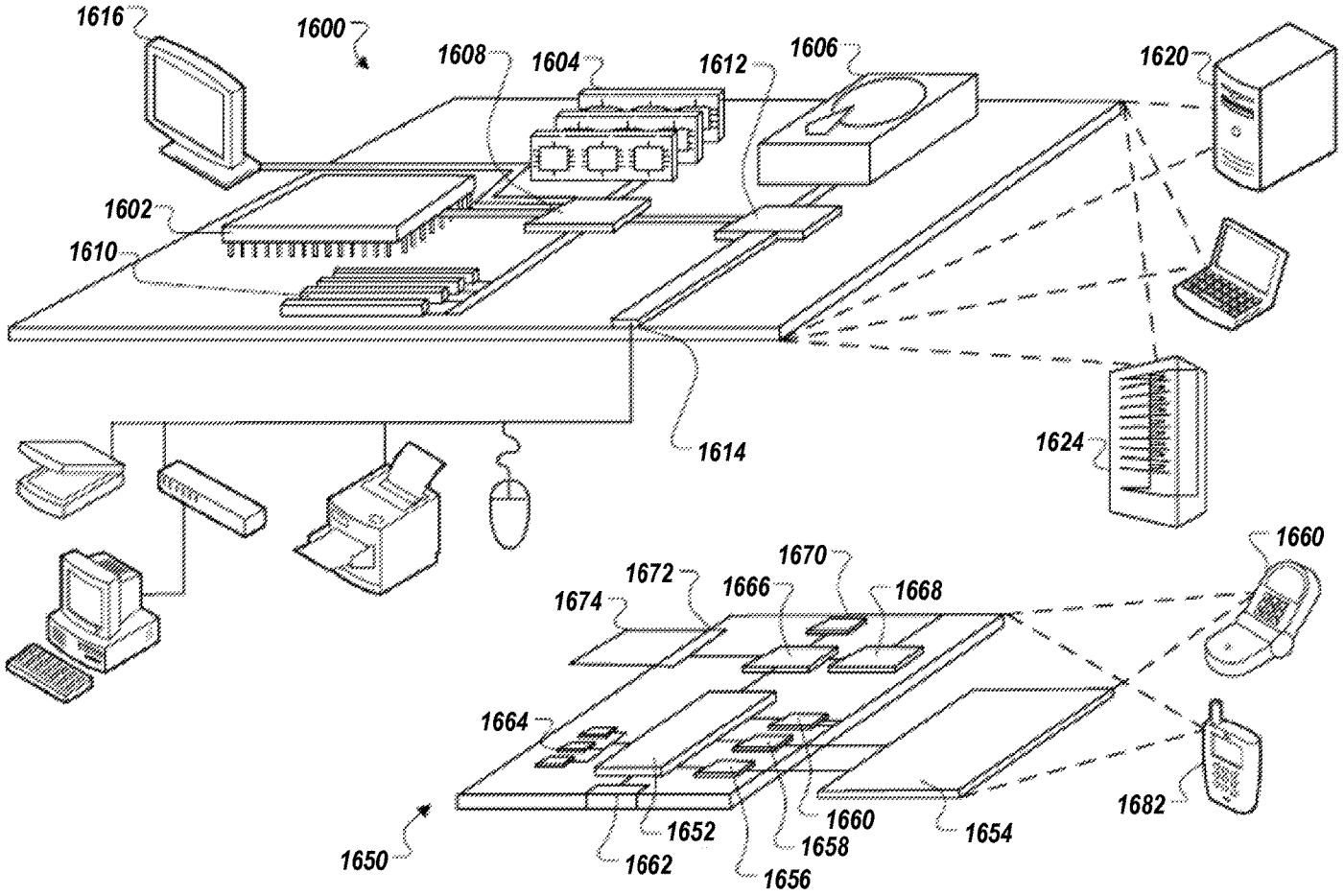
FIG. 16 is a block diagram of an example computing device and an example mobile computing device, for use in illustrative embodiments of the invention.

FIG. 16 shows an example of a computing device 1600 and a mobile computing device 1650 that can be used in the methods and systems described in this disclosure. The computing device 1600 is intended to represent various forms of digital computers, such as laptops, desktops, workstations, personal digital assistants, servers, blade servers, mainframes, and other appropriate computers. The mobile computing device 1650 is intended to represent various forms of mobile devices, such as personal digital assistants, cellular telephones, smartphones, and other similar computing devices. The components shown here, their connections and relationships, and their functions, are meant to be examples only, and are not meant to be limiting.

The computing device 1600 includes a processor 1602, a memory 1604, a storage device 1606, a high-speed interface 1608 connecting to the memory 1604 and multiple high-speed expansion ports 1610, and a low-speed interface 1612 connecting to a low-speed expansion port 1614 and the storage device 1606. Each of the processor 1602, the memory 1604, the storage device 1606, the high-speed interface 1608, the high-speed expansion ports 1610, and the low-speed interface 1612, are interconnected using various busses, and may be mounted on a common motherboard or in other manners as appropriate. The processor 1602 can process instructions for execution within the computing device 1600, including instructions stored in the memory 1604 or on the storage device 1606 to display graphical information for a GUI on an external input/output device, such as a display 1616 coupled to the high-speed interface 1608. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 1604 stores information within the computing device 1600. In some implementations, the memory 1604 is a volatile memory unit or units. In some implementations, the memory 1604 is a non-volatile memory unit or units. The memory 1604 may also be another form of computer-readable medium, such as a magnetic or optical disk.

The storage device 1606 is capable of providing mass storage for the computing device 1600. In some implementations, the storage device 1606 may be or contain a computer readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 1602), perform one or more methods, such as those described above. The instructions can also be stored by one or more storage devices such as computer- or machine readable mediums (for example, the memory 1604, the storage device 1606, or memory on the processor 1602).

The high-speed interface 1608 manages bandwidth-intensive operations for the computing device 1600, while the low-speed interface 1612 manages lower bandwidth-intensive operations. Such allocation of functions is an example only. In some implementations, the high-speed interface 1608 is coupled to the memory 1604, the display 1616 (e.g., through a graphics processor or accelerator), and to the high-speed expansion ports 4 510, which may accept various expansion cards (not shown). In the implementation, the low-speed interface 1612 is coupled to the storage device 4 506 and the low-speed expansion port 4 514. The low-speed expansion port 1614, which may include various communication ports (e.g., USB, Bluetooth®, Ethernet, wireless Ethernet) may be coupled to one or more input/output devices, such as a keyboard, a pointing device, a scanner, or a networking device such as a switch or router, e.g., through a network adapter.

The computing device 1600 may be implemented in a number of different forms, as shown in the figure. For example, it may be implemented as a standard server 1620, or multiple times in a group of such servers. In addition, it may be implemented in a personal computer such as a laptop computer 1622. It may also be implemented as part of a rack server system 1624. Alternatively, components from the computing device 1600 may be combined with other components in a mobile device (not shown), such as a mobile computing device 1650. Each of such devices may contain one or more of the computing device 1600 and the mobile computing device 1650, and an entire system may be made up of multiple computing devices communicating with each other.

The mobile computing device 1650 includes a processor 1652, a memory 1664, an input/output device such as a display 1654, a communication interface 1666, and a transceiver 1668, among other components. The mobile computing device 1650 may also be provided with a storage device, such as a micro-drive or other device, to provide additional storage. Each of the processor 1652, the memory 1664, the display 1654, the communication interface 1666, and the transceiver 1668, are interconnected using various buses, and several of the components may be mounted on a common motherboard or in other manners as appropriate.

The processor 1652 can execute instructions within the mobile computing device 1650, including instructions stored in the memory 1664. The processor 1652 may be implemented as a chipset of chips that include separate and multiple analog and digital processors. The processor 1652 may provide, for example, for coordination of the other components of the mobile computing device 1650, such as control of user interfaces, applications run by the mobile computing device 1650, and wireless communication by the mobile computing device 1650.

The processor 1652 may communicate with a user through a control interface 1658 and a display interface 1656 coupled to the display 1654. The display 1654 may be, for example, a TFT (Thin-Film-Transistor Liquid Crystal Display) display or an OLED (Organic Light Emitting Diode) display, or other appropriate display technology. The display interface 1656 may comprise appropriate circuitry for driving the display 1654 to present graphical and other information to a user. The control interface 1658 may receive commands from a user and convert them for submission to the processor 1652. In addition, an external interface 1662 may provide communication with the processor 1652, so as to enable near area communication of the mobile computing device 1650 with other devices. The external interface 1662 may provide, for example, for wired communication in some implementations, or for wireless communication in other implementations, and multiple interfaces may also be used.

The memory 1664 stores information within the mobile computing device 1650. The memory 1664 can be implemented as one or more of a computer-readable medium or media, a volatile memory unit or units, or a non-volatile memory unit or units. An expansion memory 1674 may also be provided and connected to the mobile computing device 1650 through an expansion interface 1672, which may include, for example, a SIMM (Single In Line Memory Module) card interface. The expansion memory 1674 may provide extra storage space for the mobile computing device 1650, or may also store applications or other information for the mobile computing device 1650. Specifically, the expansion memory 1674 may include instructions to carry out or supplement the processes described above, and may include secure information also. Thus, for example, the expansion memory 1674 may be provided as a security module for the mobile computing device 1650, and may be programmed with instructions that permit secure use of the mobile computing device 1650. In addition, secure applications may be provided via the SIMM cards, along with additional information, such as placing identifying information on the SIMM card in a non-hackable manner.

The memory may include, for example, flash memory and/or NVRAM memory (nonvolatile random access memory), as discussed below. In some implementations, instructions are stored in an information carrier and, when executed by one or more processing devices (for example, processor 1652), perform one or more methods, such as those described above. The instructions can also be stored by one or more storage devices, such as one or more computer- or machine-readable mediums (for example, the memory 1664, the expansion memory 1674, or memory on the processor 1652). In some implementations, the instructions can be received in a propagated signal, for example, over the transceiver 1668 or the external interface 1662.

The mobile computing device 1650 may communicate wirelessly through the communication interface 1666, which may include digital signal processing circuitry where necessary. The communication interface 1666 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 1668 using a radio-frequency. In addition, short-range communication may occur, such as using a Bluetooth®, Wi-Fi™, or other such transceiver (not shown). In addition, a GPS (Global Positioning System) receiver module 1670 may provide additional navigation- and location-related wireless data to the mobile computing device 1650, which may be used as appropriate by applications running on the mobile computing device 1650.

The mobile computing device 1650 may also communicate audibly using an audio codec 1660, which may receive spoken information from a user and convert it to usable digital information. The audio codec 1660 may likewise generate audible sound for a user, such as through a speaker, e.g., in a handset of the mobile computing device 1650. Such sound may include sound from voice telephone calls, may include recorded sound (e.g., voice messages, music files, etc.) and may also include sound generated by applications operating on the mobile computing device 1650.

The mobile computing device 1650 may be implemented in a number of different forms, as shown in the figure. For example, it may be implemented as a cellular telephone 1680. It may also be implemented as part of a smart-phone 1682, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A system for automated optimization (tuning) of a multi-mode inductively coupled plasma mass spectrometer (ICP-MS), the system comprising:

a plasma gas source;

an inductively coupled plasma torch (ICP torch) and RF coil for generating a plasma in which an analyte sample is introduced and from which an ion beam exits;

a vacuum chamber into which the ion beam enters, wherein the vacuum chamber comprises a mass analyzer and detector for detection and/or quantification of analyte ionic species in the analyte sample; and a controller for carrying out an automated optimization routine, wherein the controller is operatively connected to a computer-readable medium comprising instructions, that, when executed, cause a processor to:

receive user data input regarding an optimization to be performed on the ICP-MS for tuning of components of the ICP-MS for accurate detection and/or quantification of analyte ionic species in the analyte sample, wherein the user data input comprises an identification of one or more selected modes of operation in which the ICP-MS is to be operated;

receive a user input for initiating an automated optimization routine for the tuning of components of the ICP-MS for accurate detection and/or quantification of analyte ionic species in the analyte sample; and following receipt of the user input for initiating the routine, transmit a first signal to the controller, wherein the first signal, when received, causes the controller to perform the automated optimization routine for the tuning of components of the ICP-MS, wherein the automated optimization routine comprises an ICP-MS performance assessment subsequence, said subsequence comprising the steps of (a) automatically conducting a first performance assessment comprising a preliminary evaluative check of instrument sensitivity, said preliminary evaluative check comprising comparing a sensitivity of a measurement of a calibration standard solution by the ICP-MS to predetermined instrument performance specifications, then, (i) responsive to a determination, by the processor, that the first performance assessment is unsatisfactory, ending the ICP-MS subsequence and identifying the ICP-MS performance assessment subsequence as failed, and (ii) responsive to a determination, by the processor, that the first performance assessment is satisfactory, conducting a second performance assessment, wherein the first performance assessment contains fewer steps and is less time consuming to conduct than the second performance assessment, then (A) responsive to a determination, by the processor, that the second performance assessment is unsatisfactory, ending the ICP-MS subsequence and identifying the ICP-MS performance assessment subsequence as failed, and (B) responsive to a determination, by the processor, that the second performance assessment is satisfactory, ending the subsequence and identifying the ICP-MS performance assessment subsequence as passed, wherein the instructions cause the processor, responsive to an identification of the ICP-MS performance assessment subsequence is as failed, to transmit a second signal to the controller, identifying the ICP-MS performance assessment subsequence as failed and tuning of the ICP-MS as being needed, wherein the second signal, when received by the controller, causes the controller to perform the tuning of the components of the ICP-MS, wherein the tuning comprises automatic adjustment of the ICP torch per an optimization subroutine, wherein the optimization subroutine comprises automatically adjusting an alignment of an X-Y position of the ICP torch relative to an ion optics assembly of the ICP-MS, wherein the X-Y position of the ICP torch corresponds to vertical and horizontal settings of the ICP torch.

2. The system of claim 1, wherein the one or more selected modes include one, two, or all three of: (a) a vented cell mode, (b) a reaction cell mode, and (c) a collision cell mode.

3. The system of claim 1, wherein the user input for initiating the routine comprises at least one action selected from the group consisting of a 'single click', a keystroke, a swipe, and a selection of a graphical user interface widget.

4. The system of claim 1, wherein the automated optimization routine comprises a plurality of levels, each level having a further optimization subroutine associated therewith followed by a further ICP-MS performance assessment subsequence that indicates whether to proceed from one level of said plurality of levels of the automated optimization routine to a subsequent level.

5. The system of claim 1, wherein the adjustment of one or more components of the ICP-MS further comprises one or more steps selected from the group consisting of (i) quadrupole ion deflector (QID) optimization, (ii) quadrupole rod offset (QRO), (iii) nebulizer gas flow optimization, (iv) cell rod offset (CRO) optimization, (v) cell entrance and/or exit optimization, (vi) mass calibration, and (vii) detector optimization.

6. The system of claim 1, wherein the automated tuning of one or Mare components of the ICP-MS further comprises:

one or both of (i) a nebulizer gas flow optimization step, and (ii) a quadrupole ion deflector (QID) optimization step, said automated optimization routine comprising a dynamic range optimization subsequence associated with steps (i) and/or (ii), wherein the dynamic range optimization subsequence comprises initiating the associated step (i) and/or (ii) by adjusting an associated setting within a predetermined initial range determined from a stored value of the associated setting identified in a previous optimization of the ICP-MS, and if optimization criteria are not met within the predetermined initial range, automatically identifying a range in a direction of improved performance, continuing to identify subsequent ranges until the optimization criteria are met, and recording an adjusted, associated setting for later use.

7. The system of claim 1, wherein the tuning of components of the ICP-MS further comprises one or both of (i) a cell rod offset (CRO) step, and (ii) a cell entrance/exit step, said automated optimization routine comprising a normalization subroutine associated with the cell rod optimization step and/or the cell entrance/exit step, wherein the normalization subroutine comprises identifying an optimized setting associated with the step by normalizing pulse intensities determined from the ICP-MS at respective voltages, for each of a plurality of analytes, and using normalized values to identify the optimized setting.

8. The system of claim 7, wherein the normalization subroutine further comprises the step of multiplying the normalized values at the respective voltages and identifying a best compromised point from the result, thereby identifying the optimized setting.

9. The system of claim 1, the system further comprising an autosampler, wherein the automated optimization routine comprises a smart sampling subroutine comprising (i) the step of identifying, during the automated optimization routine, if and when use of a first analyte solution should be discontinued and use of a second analyte solution be initiated, and (ii) the step of, upon identification that the first analyte solution should be discontinued and use of the second analyte solution be initiated, transmitting, by the processor, a signal to initiate automated introduction of the second analyte solution in the ICP-MS via the autosampler.

10. The system of claim 1, wherein the automated optimization routine comprises the step of rendering, by the processor, for presentation on a graphical user interface, graphical and/or alphanumeric output representing one or more steps being performed in the automated optimization routine.

11. The system of claim 10, wherein the automated optimization routine comprises the step of displaying the graphical and/or alphanumeric output on the graphical user interface in real time as the corresponding one or more steps are being performed during the automated optimization routine.

12. The system of claim 1, wherein the user data input regarding the optimization further comprises an indication of cell gas flow rate.

13. The system of claim 1, wherein the instructions, when executed, cause the processor to, responsive to an identification of the ICP-MS performance assessment subsequence as passed, transmit a third signal to the controller, identifying the ICP-MS performance assessment subsequence as passed and tuning of the ICP-MS as not being needed, wherein the third signal, when received by the controller, causes the controller to end the automated optimization routine.

14. The system of claim 4, wherein the further ICP-MS performance assessment subsequence following each further optimization subroutine comprises a short performance assessment followed by a long performance assessment, wherein the short performance assessment contains fewer steps and is less time consuming to conduct than the long performance assessment, and wherein the further ICP-MS performance assessment subsequence ends if the short performance assessment is determined by the processor to have failed such that a next further optimization subroutine can proceed without conducting the long performance assessment.

15. The system of claim 4, wherein the plurality of levels comprises a first-performed level, comprising the automatic adjustment of the alignment of the X-Y position of the ICP torch by the optimization subroutine and one or both automated adjustments selected from the group consisting of (i) nebulizer gas flow optimization and (ii) quadrupole ion deflector (QID) optimization.

16. The system of claim 15, wherein the plurality of levels comprises a second-performed level performed subsequent to the first-performed level, the second-performed level comprising one or more automated adjustments selected from the group consisting of (i) cell rod offset (CRO) optimization, (ii) cell entrance and/or exit optimization, (iii) quadrupole ion deflector (QID) optimization, and (iv) nebulizer gas flow optimization.

17. The system of claim 16, wherein the plurality of levels comprises a third-performed level, performed subsequent to the second-performed level, the third-performed level comprising mass calibration.

18. The system of claim 17, wherein the plurality of levels comprises a fourth-performed level, performed subsequent to the third-performed level, the fourth performed level comprising detector optimization.

19. The system of claim 1, wherein the first performance assessment comprises using the ICP-MS to measure a signal intensity value for the calibration standard solution, said solution comprising one or more analytes, and comparing the signal intensity value to a predefined threshold.

20. The system of claim 19, wherein the one or more analytes are selected from the group consisting of Beryllium ($^{9}$Be), Indium ($^{115}$In), and Uranium ($^{238}$U).

21. The system of claim 19, wherein the determination that the first performance assessment is unsatisfactory comprises an assessment that the signal intensity value does not satisfy a predetermined criteria and/or an assessment that the signal intensity value is below the predefined threshold.

22. The system of claim 19, wherein the determination that the first performance assessment is satisfactory comprises an assessment that the signal intensity value satisfies a predetermined criteria and/or an assessment that the signal intensity value is at or exceeds the predefined threshold.

23. The system of claim 1, wherein the second performance assessment comprises using the ICP-MS to measure a signal intensity value of one or more analytes of the calibration standard solution not tested in the preliminary evaluative check and/or wherein the second performance assessment comprises evaluation of a criterion in addition to those in the preliminary evaluative check.

24. The system of claim 23, wherein the determination that the second performance assessment is unsatisfactory comprises an assessment that the signal intensity value does not satisfy a predetermined criteria and/or an assessment that the signal intensity value is below a predefined threshold.

25. The system of claim 23, wherein the determination that the second performance assessment is satisfactory comprises an assessment that the signal intensity value satisfies a predetermined criteria and/or an assessment that the signal intensity value is at or exceeds a predefined threshold.

* * * * *